US011255180B2

(12) United States Patent
Zhang et al.

(10) Patent No.: US 11,255,180 B2
(45) Date of Patent: Feb. 22, 2022

(54) ROBUST EARLY KICK DETECTION USING REAL TIME DRILLING

(71) Applicant: Landmark Graphics Corporation, Houston, TX (US)

(72) Inventors: Shang Zhang, Tulsa, OK (US); Hewei Tang, College Station, TX (US); Feifei Zhang, Spring, TX (US); Suresh Venugopal, Spring, TX (US); Patrick McCormack, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/640,666

(22) PCT Filed: Dec. 22, 2017

(86) PCT No.: PCT/US2017/068299
§ 371 (c)(1),
(2) Date: Feb. 20, 2020

(87) PCT Pub. No.: WO2019/125494
PCT Pub. Date: Jun. 27, 2019

(65) Prior Publication Data

US 2020/0355059 A1 Nov. 12, 2020

(51) Int. Cl.
*E21B 21/08* (2006.01)
*E21B 45/00* (2006.01)
(Continued)

(52) U.S. Cl.
CPC ..... *E21B 44/06* (2013.01); *E21B 21/08* (2013.01); *E21B 44/00* (2013.01); *E21B 45/00* (2013.01); *E21B 47/04* (2013.01); *E21B 47/10* (2013.01)

(58) Field of Classification Search
CPC ..... E21B 21/08; E21B 44/00; E21B 44/02; E21B 45/00; E21B 47/10
See application file for complete search history.

(56) References Cited

U.S. PATENT DOCUMENTS 4,440,239 A * 4/1984 Evans ..... E21B 21/08 175/5
5,154,078 A * 10/1992 Codazzi ..... E21B 47/107 73/152.22
(Continued)

FOREIGN PATENT DOCUMENTS

WO WO 2007/124330 A2 11/2007
WO WO-2013126064 A1 * 8/2013 ..... E21B 21/08
(Continued)

OTHER PUBLICATIONS

Mickens et al., "Automated Trend-Based Alerting Enhances Real-Time Hazard Avoidance," *SPE/IADC Drilling Conference and Exhibition*, Mar. 14-16, 2017, The Hague, The Netherlands.
(Continued)

*Primary Examiner* — Jennifer H Gay
(74) *Attorney, Agent, or Firm* — Haynes and Boone, LLP

(57) ABSTRACT

Embodiments of the subject technology provide for receiving real-time drilling data comprising different drilling parameters measured during a drilling operation. The subject technology calculates a kick detection parameter based at least in part on the different drilling parameters. The subject technology detects an occurrence of a kick during the drilling operation when the kick detection parameter deviates from a trend formed by previously calculated kick detection parameters. Further, the subject technology activates an alarm during the drilling operation in response to detected occurrence of the kick to facilitate preventing a blowout.

20 Claims, 10 Drawing Sheets

(51) Int. Cl.

| | |
|---|---|
| ***E21B 47/10*** | (2012.01) |
| ***E21B 44/06*** | (2006.01) |
| ***E21B 47/04*** | (2012.01) |
| ***E21B 44/00*** | (2006.01) |

(56) References Cited

U.S. PATENT DOCUMENTS

| | | | | |
|---|---|---|---|---|
| 5,275,040 | A * | 1/1994 | Codazzi | E21B 21/08 73/152.22 |
| 6,234,250 | B1 * | 5/2001 | Green | E21B 47/003 166/250.03 |
| 6,820,702 | B2 * | 11/2004 | Niedermayr | E21B 21/08 175/57 |
| 6,892,812 | B2 * | 5/2005 | Niedermayr | E21B 44/00 166/250.15 |
| 9,528,334 | B2 * | 12/2016 | Davis | E21B 44/00 |
| 9,567,843 | B2 * | 2/2017 | Saeed | E21B 21/08 |
| 9,670,767 | B2 * | 6/2017 | Hernandez | E21B 47/10 |
| 9,725,974 | B2 * | 8/2017 | Lovorn | E21B 21/08 |
| 10,060,208 | B2 * | 8/2018 | Gumus | E21B 7/00 |
| 10,113,408 | B2 * | 10/2018 | Pobedinski | E21B 44/00 |
| 10,400,572 | B2 * | 9/2019 | Lovorn | E21B 47/02 |
| 10,443,329 | B2 * | 10/2019 | Savage | E21B 44/06 |
| 2003/0168258 | A1 * | 9/2003 | Koederitz | E21B 21/08 175/38 |
| 2004/0040746 | A1 * | 3/2004 | Niedermayr | E21B 44/00 175/38 |
| 2009/0173150 | A1 | 7/2009 | DiFoggio et al. | |
| 2011/0024189 | A1 * | 2/2011 | Saeed | E21B 44/00 175/40 |
| 2012/0241217 | A1 * | 9/2012 | Davis | E21B 44/00 175/26 |
| 2013/0133948 | A1 * | 5/2013 | Lovorn | E21B 21/08 175/24 |
| 2014/0345940 | A1 * | 11/2014 | Milner | E21B 21/08 175/24 |
| 2015/0235544 | A1 * | 8/2015 | Hernandez | E21B 7/00 340/853.1 |
| 2016/0097270 | A1 * | 4/2016 | Pobedinski | E21B 44/00 700/275 |
| 2016/0102511 | A1 * | 4/2016 | Brana | E21B 21/08 175/25 |
| 2016/0245027 | A1 * | 8/2016 | Gumus | E21B 21/08 |
| 2017/0037691 | A1 * | 2/2017 | Savage | E21B 21/08 |
| 2017/0037721 | A1 * | 2/2017 | Lovorn | E21B 47/06 |
| 2018/0187498 | A1 * | 7/2018 | Sanchez Soto | E21B 21/08 |
| 2018/0328159 | A1 * | 11/2018 | Mandava | E21B 47/10 |
| 2020/0080410 | A1 * | 3/2020 | Kjosmoen | G01V 99/005 |
| 2020/0302353 | A1 * | 9/2020 | Tang | E21B 21/08 |
| 2020/0355059 | A1 * | 11/2020 | Zhang | E21B 45/00 |
| 2021/0002995 | A1 * | 1/2021 | Botnan | E21B 19/165 |
| 2021/0010365 | A1 * | 1/2021 | Botnan | E21B 21/08 |
| 2021/0071486 | A1 * | 3/2021 | Botnan | E21B 44/00 |

FOREIGN PATENT DOCUMENTS

| | | | | |
|---|---|---|---|---|
| WO | WO-2014066981 | A * | 5/2014 | E21B 44/00 |
| WO | WO-2015102581 | A1 * | 7/2015 | E21B 47/06 |
| WO | WO-2018231278 | A1 * | 12/2018 | E21B 47/10 |

OTHER PUBLICATIONS

Baker Hughs Surface Logging Services.

Halliburton Surface Data Logging, DrillFact™ Real-Time Monitoring Service.

International Search Report and The Written Opinion of the International Search Authority, or Declaration, dated Sep. 21, 2018, PCT/US2017/068299, 18 pages, ISA/KR.

NOV ItelliServ Product Catalog.

NOV RigSense™ Rigsite Information System.

Pavel et al., "Advanced Pressure Control Improves Kick, Loss Detection," *Oil & Gas Journal*, Dec. 6, 2010.

Pritchard et al., "Trends in Monitoring: How to Use Real-Time Data Effectively," *Society of Petroleum Engineers, Journal of Petroleum Technology*, vol. 64, Issue 1, Jan. 2012.

Schlumberger Flag Fluid Loss & Gain Detection Service.

Schlumberger Rig Integral MPD Equipment and Services.

Weatherford Mud Logging Services, 2018.

Weatherford, GPC GeoPressure Consulting Services for Pore Pressure Evaluation, 2010.

* cited by examiner

ROBUST EARLY KICK DETECTION USING REAL TIME DRILLING

CROSS REFERENCE TO RELATED APPLICATIONS

The present application is a U.S. National Stage patent application of International Patent Application No. PCT/US2017/068299, filed on Dec. 22, 2017, the benefit of which is claimed and the disclosure of which is incorporated herein by reference in its entirety.

TECHNICAL FIELD

The present description generally relates to detecting formation kick in a wellbore, including robust early detection of formation kick in a wellbore, e.g., while a drilling operation is being concurrently performed.

BACKGROUND

Formation kick ("kick") is the undesired flow of formation fluid into a wellbore when wellbore hydrostatic pressure is less than a formation pore pressure. If the kick is not detected and controlled in time, a blowout accident can occur.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Wells, also referred to as wellbores, are drilled to reach underground petroleum and other subterranean hydrocarbons. While or after a well is being drilled, obtaining information relating to parameters and conditions downhole is desirable. These include modular hardware and software components with appropriate sensors and controls for the type of drilling being undertaken. Many drill rig and drilling parameters can be recorded in a real-time manner at preset (and frequent) time or depth intervals. Such information may include, for example, complete and accurate time-based records of work carried out on the rig, characteristics of the earth formations traversed by the wellbore, in addition to data relating to the size and configuration of the wellbore itself. The collection of information relating to conditions surface and downhole, which commonly is referred to as a "data log," can be performed by several methods described further below in FIG. 1.

Figure 1:
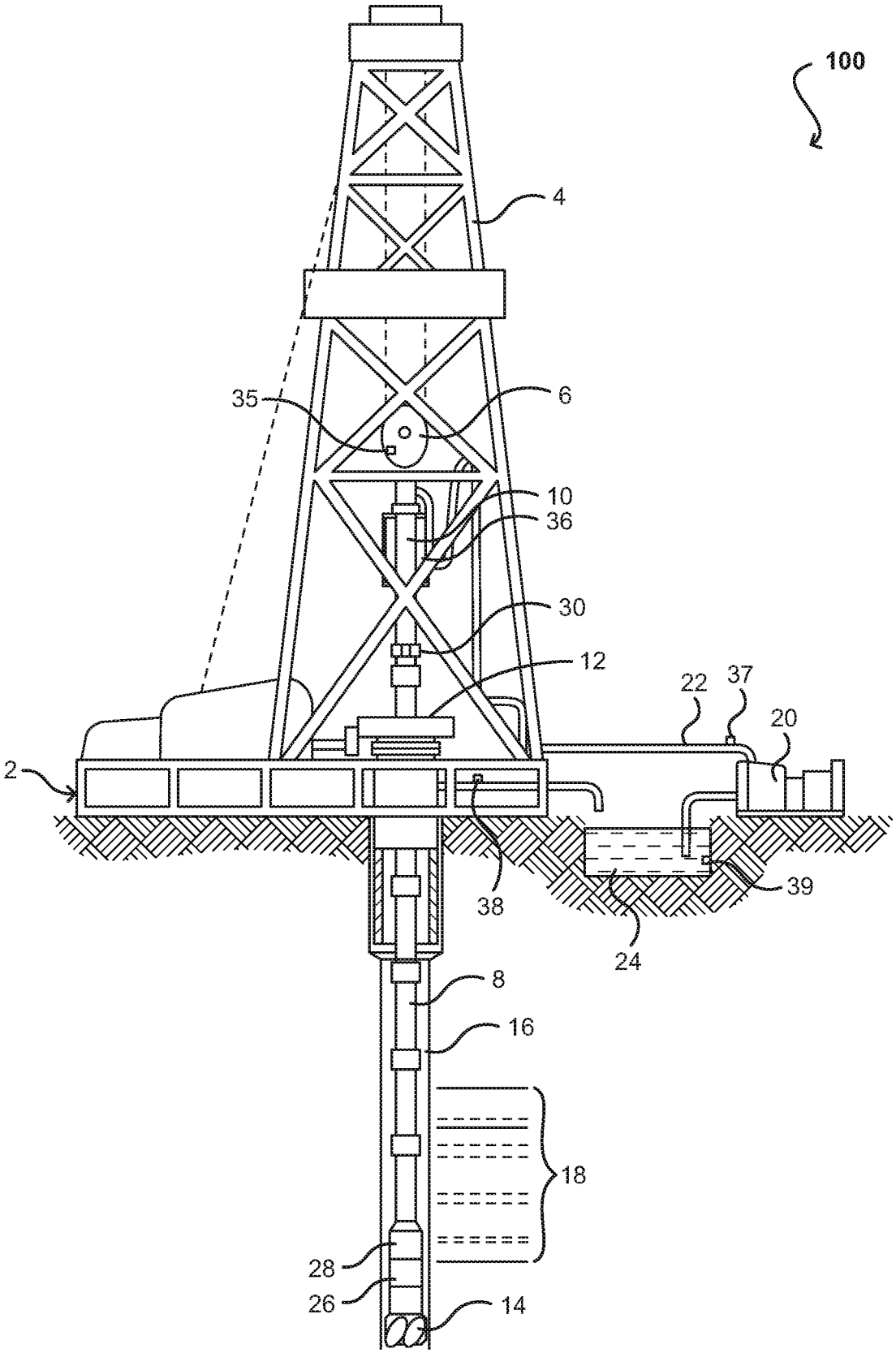
FIG. 1 illustrates an example drilling data logging environment including a drilling rig in accordance with some implementations.

Techniques for measuring conditions downhole and the movement and position of a drilling assembly, contemporaneously with the drilling of the well, may be referred to as "measurement-while-drilling" techniques, or "MWD" as mentioned herein. The measurement of formation properties by a given MWD system (e.g., as illustrated in FIG. 1), during drilling of a wellbore into a subterranean formation, can improve the timeliness of receiving measurement data and, as a result, be utilized by implementations described herein to detect a kick during the drilling operation. Similar techniques, concentrating more on the measurement of formation parameters of the type associated with wireline tools, have been referred to as "logging while drilling" techniques, or "LWD." While distinctions between MWD and LWD may exist, the terms MWD and LWD often are used interchangeably. For the purposes of explanation in this disclosure, the term drilling data log will be used with the understanding that the drilling data log encompasses surface measurements, MWD and LWD techniques.

FIG. 1 illustrates an example drilling data logging environment including a drilling rig 100 for drilling a well, also referred to as a wellbore. As shown, a drilling platform 2 supports a derrick 4 having a traveling block 6 for raising and lowering a drill string 8. A kelly 10 supports the drill string 8 as it is lowered through a rotary table 12. A drill bit 14 is driven by a downhole motor and/or rotation of the drill string 8. As the drill bit 14 rotates, it creates a wellbore 16 that passes through various formations 18. A pump 20 circulates drilling fluid through a feed pipe 22 to kelly 10, through the interior of drill string 8, through orifices in drill bit 14, back to the surface (e.g., areas accessible without entering the wellbore) via the annulus around drill string 8, and into a retention pit 24. The drilling fluid transports cuttings from the wellbore into the retention pit 24.

Data logging operations can be performed during drilling operations. In an example, drilling can be carried out using a string of drill pipes connected together to form the drill string 8 that is lowered through the rotary table 12 into the wellbore. The drilling rig 100 at the surface supports the drill string 8, as the drill string 8 is operated to drill a wellbore penetrating the subterranean region. In an alternative implementation, a top drive 36 may be provided to rotate the drill string end bit without the use of the kelly 10 and the rotary table 12. A blowout preventer may be provided and includes one or more valves installed at the wellhead to prevent the escape of pressure either in the annular space between the casing and the drill pipe or in an open hole (e.g., a hole with no drill pipe) during drilling or completion operations. A mud pump may be provided (e.g., the pump 20) which refers to a large reciprocating pump used to circulate the mud (drilling fluid) on the drilling rig 100. Mud pits (e.g., the retention pit 24) are a series of open tanks, usually made of steel plates, through which the drilling mud is cycled to allow sand and sediments to settle out. In an example, additives are mixed with the mud in the retention pit 24, and the fluid is temporarily stored in the retention pit 24 before being pumped back into the wellbore. Mud pit compartments may also be called shaker pits, settling pits, and suction pits, depending on their main purpose. Additionally, one or more flow in sensors 37 may be provided to measure temperature, flow rate, and/or pressure (e.g., stand pipe pressure) of the flow in from the retention pit 24, and one or more flow out sensors 38 may be provided to measure temperature, flow rate, and/or pressure (e.g., stand pipe pressure) of the flow out from the wellbore. A pit level sensor 39 may be provided to monitor pit levels and the total pit volume of the retention pit 24. The aforementioned measurements are examples of real-time drilling data that may be utilized in implementations described herein.

In an example, the drill string 8 may include, for example, a kelly, drill pipe, a bottom hole assembly, and/or other components. The bottom hole assembly on the drill string 8 may include drill collars, drill bits, one or more logging tools, and other components. The drilling data logging tools may include pressure sensors, flow measurement sensors, load sensors, at the mud pump, drill string, mud pit, blowout preventer; measuring while drilling (MWD) tools; logging while drilling (LWD) tools; and others.

Although various example components of the drilling rig 100 are discussed above, it is appreciated that drilling data logging operations may apply to other components of the drilling rig 100 than those discussed and/or shown in FIG. 1. For example, drilling data may be provided from components such as a crown block and water table, catline boom and hoist line, drilling line, monkeyboard, traveling block, mast, doghouse, water tank, electric cable tray, engine generator sets, fuel tanks, electric control house, bulk mud components storage, reserve pits, mud gas separator, shale shaker, choke manifold, pipe ramp, pipe racks, accumulator, and/or among other types of components of the drilling rig 100. In implementations described herein, drilling data, such as real-time drilling data, may be provided by any of the aforementioned components described in connection with the drilling rig 100.

As illustrated in the example of FIG. 1, one or more MWD instruments are integrated into a logging tool 26 located near the drill bit 14. As the drill bit 14 extends the wellbore through the formations 18, the logging tool 26 concurrently collects measurements relating to various formation properties as well as the bit position and various other drilling conditions and/or drilling parameters. In an example, the logging tool 26 may take the form of a drill collar (e.g., a thick-walled tubular that provides weight and rigidity to aid the drilling process) that is positioned close to the drill bit 14. A telemetry sub 28 (e.g., a transceiver) may be included to transfer tool measurements to a surface transceiver 30 and/or to receive commands from the surface transceiver 30. Additionally, in some implementations, sensors or transducers are located at the lower end of the drill string 8. While a drilling operation is in progress such sensors can continuously monitor one or more drilling parameters and/or formation data and transmit the information to a surface detector (e.g., the surface transceiver 30 and/or a logging facility that collects measurements from the logging tool 26, and typically includes computing facilities for processing and storing the measurements gathered by the logging tool 26) by some form of telemetry.

Several potential problems can arise during a drilling and/or completion process for a wellbore. One problem may be the occurrence of a formation kick ("kick"). A kick can occur when the fluid (e.g., a liquid or a gas) in a reservoir prematurely enters a portion of a wellbore, for example, in an annular space of the wellbore. A sufficient wellbore pressure must be exerted on the subterranean formation in order to prevent the formation fluids from prematurely entering the wellbore. Wellbore pressure refers to the pressure exerted by a fluid due to the force of gravity, external pressure, and friction. If the pressure exerted by the fluid is not sufficient, then a kick could occur.

Detecting a kick as early as possible may reduce the risk of blowout, reduce the difficulty of well control, reduce non-productive time of a drilling rig, prevent tool failure caused by high pressure during well control, and improve the safety margin for operation. However, several kick indicators may be difficult to apply and can require extensive field experience in order to detect a kick. Some examples of kick indicators that require extensive field experience may include a flow rate increase (e.g., flow out is greater than flow in), a pit volume increase, a pump pressure decrease (e.g., stand pipe pressure decrease), a string weight change (e.g., weight on bit decrease), and a drilling break (e.g., sudden increase in rate of penetration).

Implementations of the subject technology provide for robust early kick detection utilizing a drilling parameter called d-exponent, which is based at least in part on real-time measurement data obtained through surface data logging, MWD and/or LWD techniques. As used herein, "real-time" or "real time" data refers to data that is measured while a drilling operation is concurrently taking place and measurements from the concurrent drilling operation are being utilized by the robust early kick detection algorithm. Real-time data, such as real-time drilling data, as used herein, includes, but is not limited to, surface measurements, subsurface measurements, measurements taken through MWD and/or LWD techniques, and/or measurements taken with any of the components of a given drilling rig (e.g., the drilling rig 100). Although the d-exponent parameter has been previously used to identify abnormal pressure formation and predict abnormal pore pressure, implementations of the subject technology utilize the d-exponent parameter for robust early kick detection, which can be determined without utilizing additional specialized equipment during a drilling operation.

The following discussion describes, in further detail, example flowcharts for a process for robust early kick detection during a drilling operation and a process that detects a drilling operation using at least in part real-time drilling data, and example diagrams illustrating kick detection based on determined d-exponent parameter values.

Figure 2:
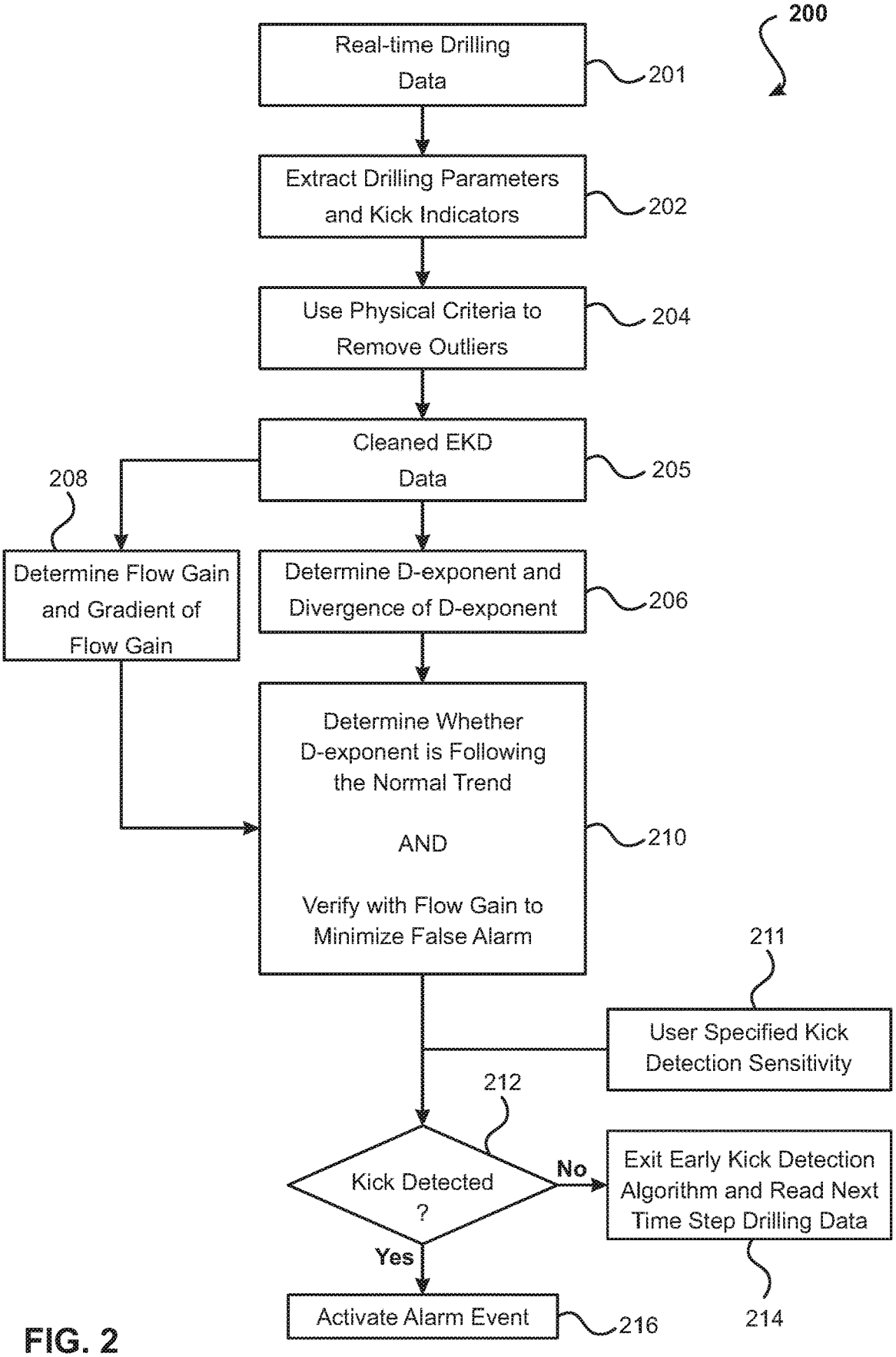
FIG. 2 conceptually illustrates an example process for robust early kick detection utilizing real-time drilling data in accordance with some implementations.

FIG. 2 conceptually illustrates an example process 200 for robust early kick detection utilizing real-time drilling data. Although this figure, as well as other process illustrations contained in this disclosure may depict functional steps in a particular sequence, the processes are not necessarily limited to the particular order or steps illustrated. The various steps portrayed in this or other figures can be changed, rearranged, performed in parallel or adapted in various ways. Furthermore, it is to be understood that certain steps or sequences of steps can be added to or omitted from the process, without departing from the scope of the various implementations. The process 200 may be implemented by one or more computing devices or systems in some implementations, such as a processor 638 described in FIG. 6 and/or the computing device 800 described in FIG. 8. FIG. 2, in an example, may be performed in conjunction (e.g., after detecting that a drilling operation is currently taking place) with a process described in FIG. 3 for detecting a drilling operation currently being performed. It is appreciated, however, that any processing performed in the process 200 by any appropriate component described herein may occur only uphole, only downhole, or at least some of both (i.e., distributed processing).

When an active drilling operation is detected, the robust early kick detection process may be dynamically/adaptively performed using incoming drilling data. In the event that a kick is detected, an alarm event related to the drilling operation is activated. Examples of an alarm event can include sounding an alarm, flashing sources of light, sending notification messages to appropriate personnel, initiating a shutdown procedure or deactivation process, etc. Drilling crews can then take any necessary actions to control the kick and to avoid a loss of well control, such as temporarily suspend the drilling operation.

At block 202, one or more drilling parameters are extracted from real-time drilling data 201. Such drilling parameters may include a rate of penetration (ROP), weight on bit (WOB), and drill string revolutions per minute (RPM) that can be utilized to determine a d-exponent value as discussed further below. In an example, the real-time drilling data, corresponding to data obtained over a given period of time, are provided from a logging tool (e.g., installed as part of a bottomhole assembly or drill string as described above in FIG. 1) to obtain measurements during a drilling operation. In another example, the real-time drilling data may be stored in a memory (e.g., memory 804 in FIG. 8) and accessed from the memory for processing. Such drilling parameters may be obtained during a drilling operation that relate to a given set of parameters for operating portions of the drilling assembly (e.g., the drill bit, drill string, etc.).

At block 204, one or more outlier values may be removed to produce cleaned (e.g., filtered) early kick detection data 205. In an example, one or more physical criteria corresponding to a range of expected values for a given parameter can be utilized to remove an outlier value. For example, a weight on bit (WOB) parameter with a value of 20,000 pounds in a given drilling operation may not be a reasonable value in view of physical criteria associated with the drilling environment and/or subterranean region such as rock strength, and can be removed from the real-time drilling data 201 as an outlier value. Rock strength may correspond to an intrinsic strength of a given rock formation, which can be based on the rock formation's composition and/or process of deposition and compaction. A sufficient WOB value has to be utilized to overcome the rock strength, along with a drill bit being able to perform under this utilized WOB. Another physical criterion may include porosity in which a value for ROP can be higher in a more porous rock formation than in a low-porosity rock formation such that a low value for ROP may be considered an outlier for a highly porous formation. In another example, an outlier value for ROP parameter can be discarded when a particular value for the ROP parameter indicates a much greater or lower ROP value than expected in view of other drilling parameters (e.g., when the RPM or WOB increases in value, the ROP may increase proportionately in value).

The process 200 determines a value of a kick detection parameter which is used as the main indicator for real-time kick detection. In some instances, the kick detection parameter is a drilling parameter for a d-exponent value (e.g., d-exponent parameter) that may be used to identify abnormal pressure formation and predict abnormal pore pressure. Kicks while drilling are caused in many instances by penetrating through abnormal pressure zones. As a result, a d-exponent value may serve as a good indicator for kick detection while drilling.

The d-exponent value can also be referred to as a normalized rate of penetration, which is a representation of multiple drilling parameters as a single value. More specifically and advantageously, the d-exponent value as determined by implementations described herein integrates drilling parameters such as rate of penetration (ROP), weight on bit (WOB), and drill string revolutions per minute (RPM) for early kick detection. By determining the d-exponent value, changes caused by a modification of an operating parameter (e.g., manually changing WOB and/or RPM during the drilling operation) can be accounted for, and a frequency for measuring data can be faster thereby enabling an early detection of a kick. Additionally, by using a d-exponent value in conjunction with other kick indicators, the detection of a kick is more robust, which can help overcome a measurement malfunction to some degree.

In one or more implementations, a d-exponent value can be represented by the following equation (1):

$$D_{exponent} = \frac{\log\left(\frac{ROP}{60 \times RPM}\right)}{log\left(\frac{12 \times WOB}{10^6 \times \phi_{Bit}}\right)}$$

where the variables in the above equation (1) are represented by the following:

ROP is in ft/hr;

RPM is in rev/min;

WOB is in pound force (lbf); and diameter of a drill bit ($Ø_{Bit}$) is in inches.

The d-exponent value is derived from a drilling rate equation, which can be represented by the following equation (2):

$$ROP = K \times RPM^E \times \left(\frac{WOB}{\phi_{Bit}}\right)^D$$

where K and E are, respectively, a drillability constant (e.g., rock strength constant for a specific type of rock) and a rotary speed exponent.

At block 206, a value of a d-exponent parameter and a divergence value of the value of the d-exponent parameter are determined. In an example, the divergence value can represent an amount by which the value of the d-exponent parameter diverges from an expected d-exponent value, which may be based on a determined trend of a series of values of the d-exponent parameter over a period of time that the real-time drilling data 201 was measured.

At block 208, conjunctively with the determination of the d-exponent parameter from block 206, a value of a flow gain may be determined and a gradient of the value of the flow gain over a period of time may be determined. The value of the flow gain may refer to a measurement of a differential flow rate between a flow in rate into a mud pump and a flow out rate out of the wellbore. The gradient of the flow gain, in an example, refers to a value indicating a degree that the differential flow rate changes over the period of time that the real-time drilling data was measured. In an example, a value of a gradient indicating a significant increase in a change to the differential flow rate may indicate that a kick has occurred.

In comparison with determining the value of d-exponent parameter, determining a value of flow gain may take a longer amount of time in an example. Determining the value of the d-exponent parameter therefore may be computationally more efficient than calculating the value of the flow gain. Moreover, in some instances, poor reliability of a sensor that is reading measurements of different parameters, as discussed further below, for determining the flow gain, may also result in foregoing utilizing flow gain as a kick indicator. Consequently, the flow gain may not be determined in some implementations in which a faster determination of a kick occurrence is desired (e.g., solely based on the d-exponent parameter). In one or more implementations, the value of the flow gain may be determined using the following equation (3):

$$Q_{gain} = Q_{out} - \frac{Q_{in}}{1 - c_r P_{spp}}$$

where $Q_{gain}$ is flow gain, $Q_{in}$ is a flow in rate, $Q_{out}$ is a flow out rate, $P_{spp}$ is a stand pipe pressure (SPP), and $c_r$ is a compressibility of drilling mud.

At block 210, it is determined whether the d-exponent parameter is following a normal trend with respect to previously determined d-exponent parameters, and the flow gain is verified as being within an expected value to mitigate a false detection of a kick, which would result in a false alarm for the drilling operation. In an example, such a normal trend is represented by calculating a best fitting line of the previously determined d-exponent parameters. To perform a more robust kick detection, for example, when the d-exponent parameter is following an abnormal trend with respect to previously determined d-exponent parameters (e.g., deviating from the determined normal trend greater than a predetermined threshold value discussed further below), the value of the gradient of the flow gain can also be checked to determine whether an abnormal increase has occurred in the flow gain. A kick is more likely to be confirmed when the abnormal trend corresponding to the d-exponent parameter occurs in conjunction with the indication of the abnormal increase of flow gain based on the gradient of the flow gain. In an example, an abnormal increase of the gradient can be determined when the change in the gradient is greater than a threshold value indicating a substantial increase in change to the differential flow rate associated with a potential occurrence of a kick.

In one or more implementations, determining an abnormal trend in the d-exponent parameter can be based on a predetermined threshold value (e.g., a user specified kick detection sensitivity value 211). In one or more implementations, a trend (e.g., a best fitting line of a series of data) may be determined based on a series of values of the d-exponent parameter determined over a period of time (or subset of time thereof) that drilling parameters were measured. A particular window of time including another series of values of the d-exponent parameter can be selected and compared to expected values of the d-exponent parameter based at least in part on the determined trend.

For example, one or more expected values of the d-exponent can be determined by extrapolation according to the determined trend and/or by applying a rate of change to a previous measurement of the d-exponent parameter. In the event that a value of the d-exponent parameter deviates from the expected value greater than the predetermined threshold value, the abnormal trend can be detected indicating a potential occurrence of a kick during the drilling operation. When the value of the d-exponent parameter does not deviate in value from the expected value greater than the predetermined threshold value, it may be determined that the d-exponent value follows a normal trend. A lower predetermined threshold value may provide a more sensitive detection of a kick during the drilling operation, and a larger predetermined threshold value may provide a less sensitive detection of a kick while potentially mitigating a false positive detection of a kick during the drilling operation. In an example, the previously determined trend may correspond to values of the d-exponent parameter determined from a period of time that occurs prior, such as immediately prior, to the selected window of time of the d-exponent parameter discussed above.

In some implementations, values for the d-exponent parameter can be within a small range of values between, for example, 0.5 to 3. In another example, an integral of an area including respective d-exponent values between a particular start time and a particular end time (e.g., as shown in plot 460) may be determined. The area, in an example, includes a period of time corresponding to initial values for the d-exponent parameter that are part of the normal trend and subsequent values of the d-exponent parameter that are part of an abnormal trend. A value of this integral can be compared to another predetermined threshold value (e.g., provided by the user specified kick detection sensitivity value 211), and if the value of the integral is greater than the threshold value, an abnormal trend can be detected which indicates a potential occurrence of a kick during the drilling operation. The user specified kick detection sensitivity value 211 in this example may be selected based on characteristics of the particular well of the drilling operation.

At block 212, it is determined whether a kick is detected based at least in part on whether the d-exponent parameter is following an abnormal trend with respect to previously determined d-exponent parameters (e.g., not following a normal trend from block 210). In at least one embodiment, if the kick is initially detected based on the d-exponent parameter following an abnormal trend, and an indication of the abnormal increase of flow gain is also detected, then a greater confidence of the kick being detected is confirmed (e.g., assigned a confidence value as discussed below). In some implementations, the d-exponent parameter may be utilized as preliminary indicator of a kick, which is then utilized in combination with the flow gain parameter to make a final determination of whether the kick was detected. In an example, a confidence value may be quantitatively determined based at least on these two parameters indicating a likelihood or probability that the kick was detected. Based at least in part on this confidence value, the process 200 may determine whether the kick was or was not detected and proceed accordingly. In another example, this confidence value may be utilized in connection with activating an alarm event as described below.

At block 214, if the kick is not detected, the robust early kick detection process 200 is exited, and a next set of drilling data for a subsequent time period is read. The subsequent time period of the next set of drilling data is in close temporal proximity to the time in which the process 200 is occurring. In an example, the operations in the process 200 may repeated for the next set of drilling data. Alternatively or in addition, the operations in a process described further below in FIG. 2 may be performed utilizing this next set of drilling data.

At block 216, in response to the kick being detected, an alarm event is activated to trigger a sound, transmit a message, such as a text message, or perform any other notification that alerts, for example, the oil drilling team or the human operator. In response to the alarm or notification, the human operator may determine to shut down or deactivate the drilling assembly (e.g., stop the rotation of the drill string). Alternatively or conjunctively, the drilling assembly (or portion thereof) may be deactivated to cease the drilling operation in an automated manner without involvement of the human operator, such as when the kick is detected with a high level of confidence based at least in part on the aforementioned confidence value from block 212.

In one or more implementations, a deactivation process may be initiated in response to the alarm event being activated, such as when the kick is detected with a high level of confidence. The deactivation process may include the performance of certain actions such as shutting down operation of the drill string, the mud pump, and/or other portions of the drilling assembly. The deactivation process, in an example, does not begin unless there is no user intervention or input from a human operator to override the deactivation process for a predetermined amount of time after the alarm event is activated (e.g. to allow time for the human operator to override the deactivation process since shutting down the drilling operation can be time consuming, disruptive, and/or costly). For example, a predetermined amount of time is waited for receiving user input from the human operator to override the deactivation process after the alarm event is activated, and after the amount of time has elapsed, the deactivation process is performed if the user input is not received.

Figure 3:
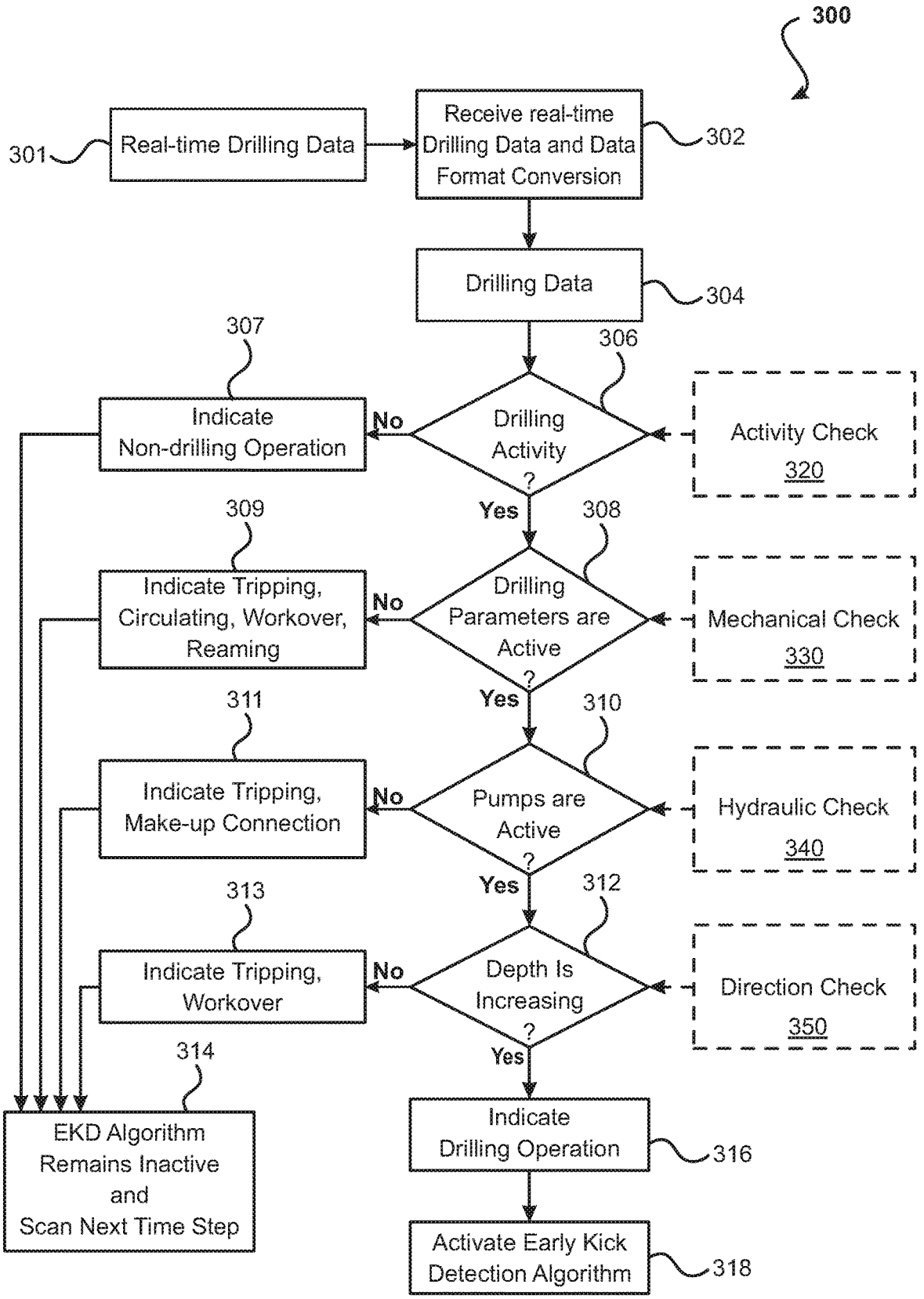
FIG. 3 conceptually illustrates an example process for detecting a drilling operation utilizing real-time drilling data in accordance with some implementations.

FIG. 3 conceptually illustrates an example process 300 for detecting a drilling operation utilizing real-time drilling data. Although this figure, as well as other process illustrations contained in this disclosure may depict functional steps in a particular sequence, the processes are not necessarily limited to the particular order or steps illustrated. The various steps portrayed in this or other figures can be changed, rearranged, performed in parallel or adapted in various ways. Furthermore, it is to be understood that certain steps or sequences of steps can be added to or omitted from the process, without departing from the scope of the various implementations. The process 300 may be implemented by one or more computing devices or systems in some implementations, such as the processor 638 described in FIG. 6 and/or the computing device 800 described in FIG. 8. FIG. 3, in an example, may be performed in conjunction (e.g., prior to performing the robust early kick detection algorithm) with the process 200 described in FIG. 2. It is appreciated, however, that any processing performed in the process 300 by any appropriate component described herein may occur only uphole, only downhole, or at least some of both (i.e., distributed processing).

Real-time drilling data 301 may be provided or received. For example, the real-time drilling data 301 may come from a logging tool (e.g., installed as part of a bottomhole assembly or drill string) during a drilling operation. In another example, the real-time drilling data 301 may be stored in a memory (e.g., memory 804 in FIG. 8) during the drilling operation and accessed from the memory for processing. At block 302, the received real-time drilling data 301 may be converted by a reading and data format conversion operation(s) to produce, as output, converted drilling data 304. In an example, the received real-time drilling data may be filtered to remove outlier values related to respective drilling parameters. The process 300 may then perform different types of checks, based on the converted drilling data 304, to determine whether a drilling operation is occurring.

At block 306, it is determined whether the converted drilling data 304 indicates a drilling activity in connection with an activity check 320. In some examples, the converted drilling data includes data that may indicate a drilling activity, such as measured drilling parameters for rate of penetration, weight on bit, and revolutions per minute as discussed above in FIG. 2. If the converted drilling data 304 does not include such drilling parameters, an indication 307 of a non-drilling operation may be provided, and the robust early kick detection process (e.g., the process 200 in FIG. 2) is not executed and a next set of real-time drilling data for a subsequent time period is accessed or received at block 314.

At block 308, in response to detecting the drilling activity, it is determined whether at least one drilling parameter is active in connection with a mechanical check 330. A particular drilling parameter, included in the drilling data, may be determined to be inactive if a value for the particular drilling parameter does not indicate that a drilling operation is currently taking place and/or indicate an erroneous sensor reading. For example, a particular drilling parameter is inactive when a weight on bit parameter is insufficient (e.g., not great enough to drill through rock in the subterranean region), or when the revolutions per minute of the drill string is too low a value (e.g., less than 10 RPM), or when the rate of penetration is greater than a value of zero but substantially close to a value of zero. If the least one drilling parameter is not active, an indication 309 of an operation for tripping (e.g., pulling the drill string out of the wellbore or replacing it in the wellbore), circulating (e.g., pumping fluid through the entire fluid system, including the wellbore and all the surface tank), workover (e.g., repair or stimulation of an existing production well), and/or reaming (e.g., enlarging the wellbore) may be provided, and the robust early kick detection process (e.g., the process 200 in FIG. 2) is not executed and a next set of real-time drilling data for a subsequent time period is accessed or received at block 314.

At block 310, in response to detecting that at least one drilling parameter is active, it is determined whether at least one pump is active in connection with a hydraulic check 340. One or more hydraulic parameters can be checked to determine whether at least one pump is active such as a pump stroke rate, pump displacement, and/or pump pressure. If the least one pump is not active, an indication 311 of an operation for tripping, and/or make up connection (e.g., adding a length of drill pipe to the drill string to continue drilling) may be provided, and the robust early kick detection process (e.g., the process 200 in FIG. 2) is not executed and a next set of real-time drilling data for a subsequent time period is accessed or received at block 314.

At block 312, in response to detecting at least one pump is active, it is determined whether depth of the drill string or portion thereof (e.g., the drill bit, drill pipe) is increasing in connection with a direction check 350. If the depth is not increasing, an indication 313 of tripping, and/or workover may be provided, and the robust early kick detection process (e.g., the process 200 in FIG. 2) is not executed and a next set of real-time drilling data for a subsequent time period is accessed or received at block 314.

At block 316, in response to detecting that the depth is increasing, a drilling operation is indicated as being currently performed. At block 318, in response to the indication that the drilling operation is being currently performed, a robust early kick detection process (e.g., the process 200 in FIG. 2) may be performed.

Figure 4:
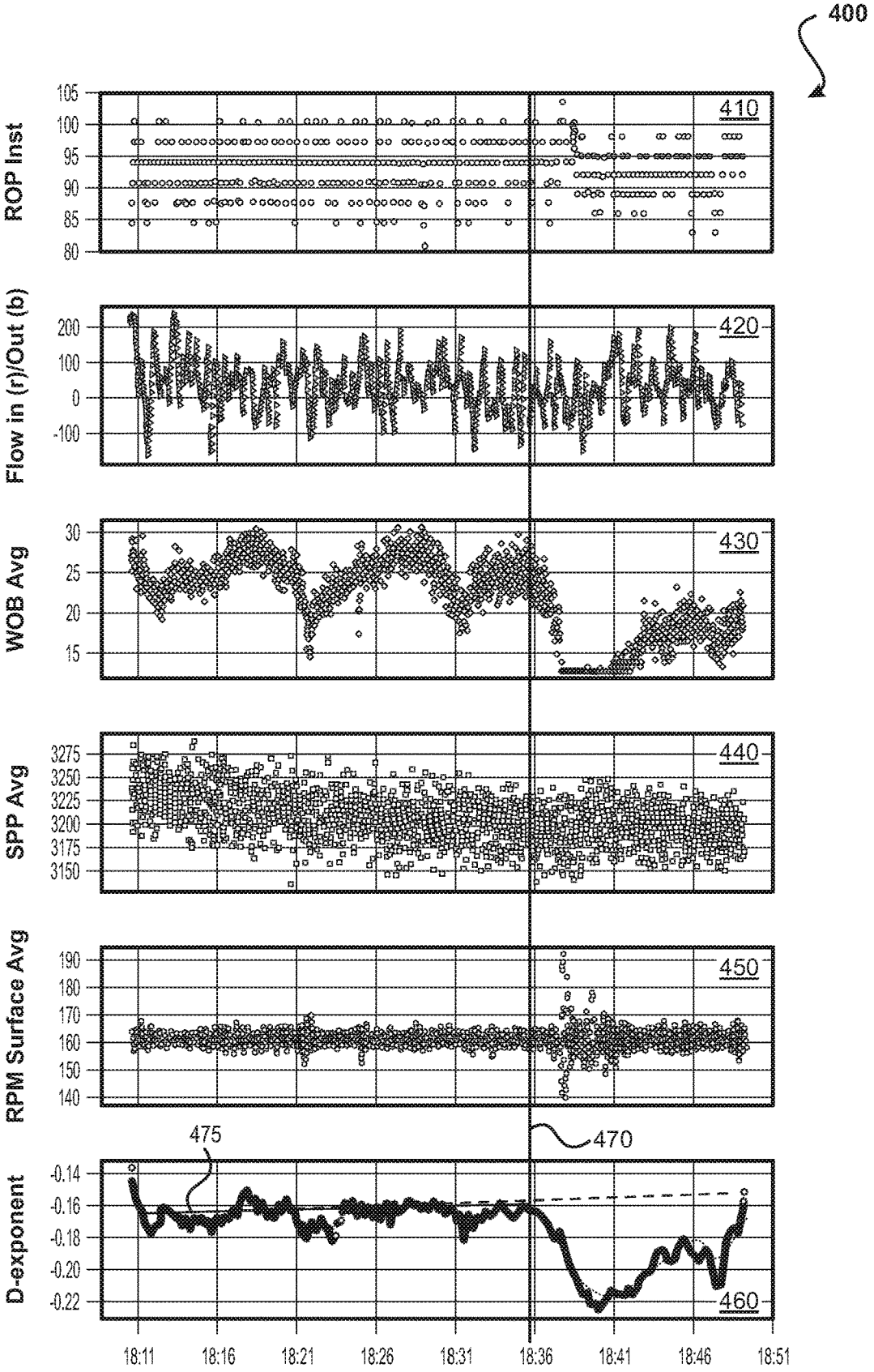
FIG. 4 illustrates example plots of real-time drilling data of a drilling operation including a d-exponent drilling parameter and other drilling parameters that may be utilized for robust early kick detection in accordance with some implementations.

FIG. 4 illustrates example plots 400 of real-time drilling data of a drilling operation including a d-exponent drilling parameter and other drilling parameters utilized in robust early kick detection in accordance with some implementations. The plots 400 include a plot 410 related to a ROP drilling parameter, a plot 420 related to a flow differential parameter, a plot 430 related to a WOB parameter, a plot 440 related to a SPP parameter, a plot 450 related to a RPM parameter, and a plot 460 related to a d-exponent parameter. In some implementations, the plots 400 may be generated and/or provided for display by one or more computing devices or systems, such as the processor 638 described in FIG. 6 and/or the computing device 800 described in FIG. 8.

In the field during a drilling operation, a kick may be observed by a drilling operator or engineer using one or more indicators of a kick. However, such kick indicators may be difficult to apply and can require substantial field experience on the part of the drilling operation or engineer to determine that a kick has occurred. By way of example, some indicators of a kick occurrence include the following:

1) flow rate increase (e.g., flow out>flow in)
2) pit volume increase (e.g., increase in volume of a surface reservoir that the drilling fluid is drawn from and returned to)
3) pump pressure decrease (e.g., SPP decrease)
4) string weight change (e.g., WOB decrease)
5) drilling break (e.g., ROP sudden increase)

In the example of FIG. 4, however, using the other drilling parameters, related to some of the aforementioned kick indicators, to determine a kick occurrence may be more difficult (e.g., may require more processing resources) or may take more time than utilizing the d-exponent parameter to detect a kick. As illustrated, a difference in values of the flow differential parameter (e.g., indicating changes in flow in and flow out) fluctuates in the plot 420. Thus, the drilling operator/engineer may not be able to determine whether the flow rate has a clear increasing trend to determine that a kick has occurred. Because the WOB parameter in the plot 430 is changing based on a seasonal pattern, identifying the change of the WOB parameter caused by a kick occurrence may be difficult, and almost no observable trend may be determined from the ROP parameter in the plot 410. The SPP parameter in the plot 440 also does not provide a usable trend to determine a kick occurrence. Further, although the RPM parameter in the plot 450 indicates a decrease with some minor shifting and varying of the RPM parameter within a small range, with some larger variance at the end, the data in the plot 450 does not easily indicate a kick occurrence.

By utilizing a d-exponent parameter, reliance on the aforementioned kick indicators may be reduced and a time to detect a kick may be quicker than utilizing the other kick indicators. As illustrated in the example of FIG. 4, the plot 460 shows that the d-exponent parameter follows a normal trend 475, and the illustrated d-exponent parameter begins to deviate from the normal trend 475 at a time of 18:36 corresponding to a line 470. In the example of FIG. 4, the line 470 corresponds to the time of 18:36 when a kick occurred. If the drilling operator were to utilize, in an example, the WOB parameter in the plot 430 to determine the kick occurrence, more time would have elapsed after the time of 18:36 before the kick is observed by the drilling operator based on the data in the plot 430 that indicates a substantial decrease in the WOB parameter long after the time of 18:36. Consequently, in this example, utilizing the d-exponent parameter in the plot 460 provides an earlier in time detection of the kick than using the WOB parameter, as the d-exponent parameter deviates from its normal trend in the plot 460 almost immediately after the kick occurred at 18:36.

Figure 5A:
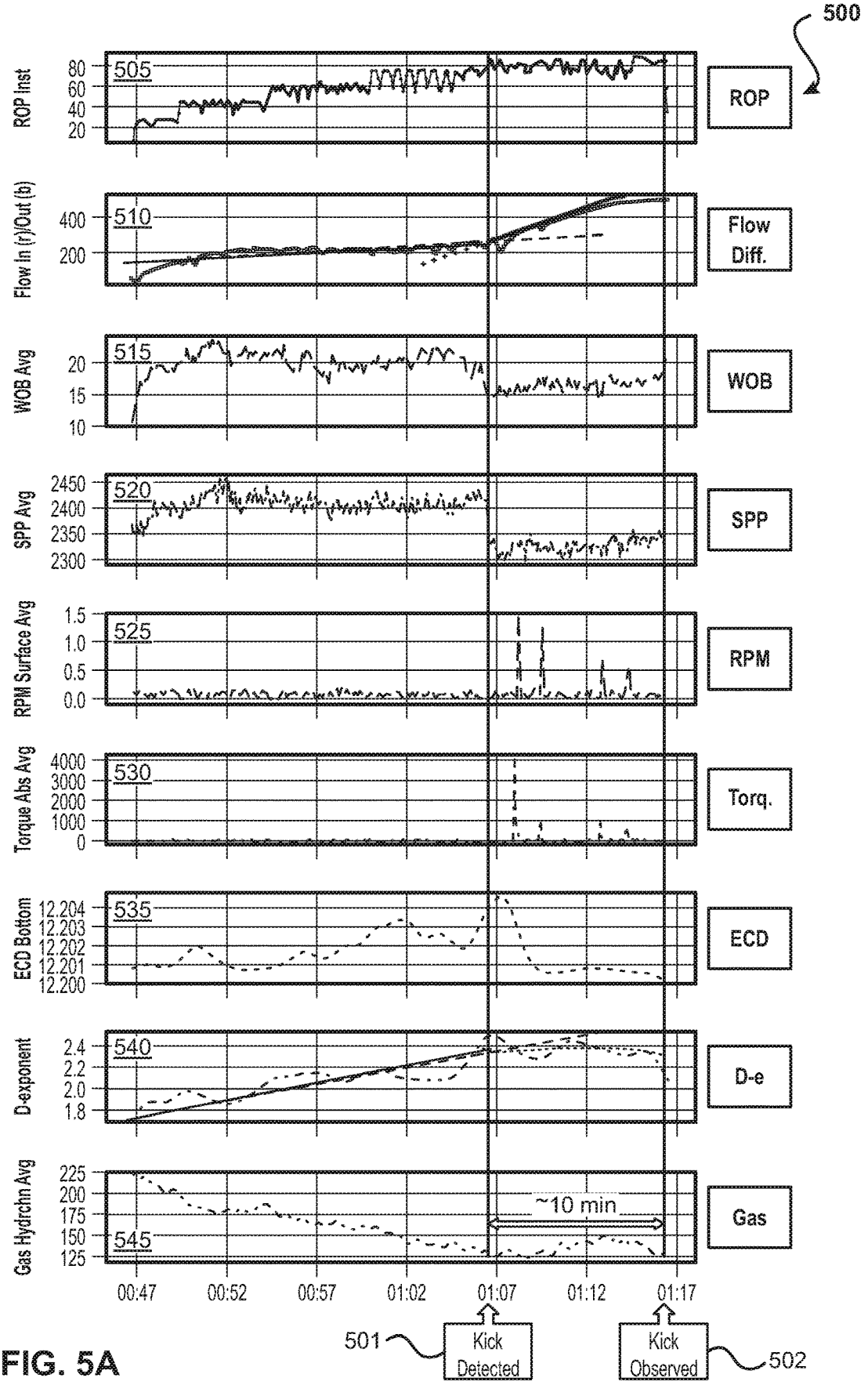
FIG. 5A illustrates example plots of real-time drilling data of a drilling operation including a d-exponent drilling parameter and other drilling parameters that may be utilized for robust early kick detection in accordance with some implementations.

FIG. 5A illustrates example plots 500 of real-time drilling data of a drilling operation including a d-exponent drilling parameter and other drilling parameters that may be utilized for robust early kick detection in accordance with some implementations. The example in FIG. 5A illustrates a difference between a time 501 when a kick is detected and a subsequent time 502 when the kick is observed in the field (e.g., at the surface) utilizing other indicators of a kick. For example, in one traditional practice, a visual observation of a kick indicator can be performed by placing a pit level marker in the mud pit, and having a human (e.g., drilling engineer or crew member) monitor the level of the mud pit. If the volume of the mud pit increases beyond the marker, it may be an indicator that a kick is occurring. According to other traditional practices in the field, kicks can also be detected by monitoring the drilling mud balance in the wellbore. For example, during the drilling operation, the flow into the wellbore can be measured indirectly based on a number of strokes the drilling mud pump performs and by the volumetric displacement of the mud pump. This flow in rate of mud is compared with the flow out rate of mud from the wellbore, which in some cases is determined using a conventional instrument such as paddle deflection flowmeter. In another example of traditional practices, the drilling operator can monitor other indicators of surface or downhole conditions such as a sudden decrease in stand pipe pressure, or an increase in gas content in the mud indicating that more gas is entering the wellbore, to determine that a kick may have occurred in the field.

Figure 6:
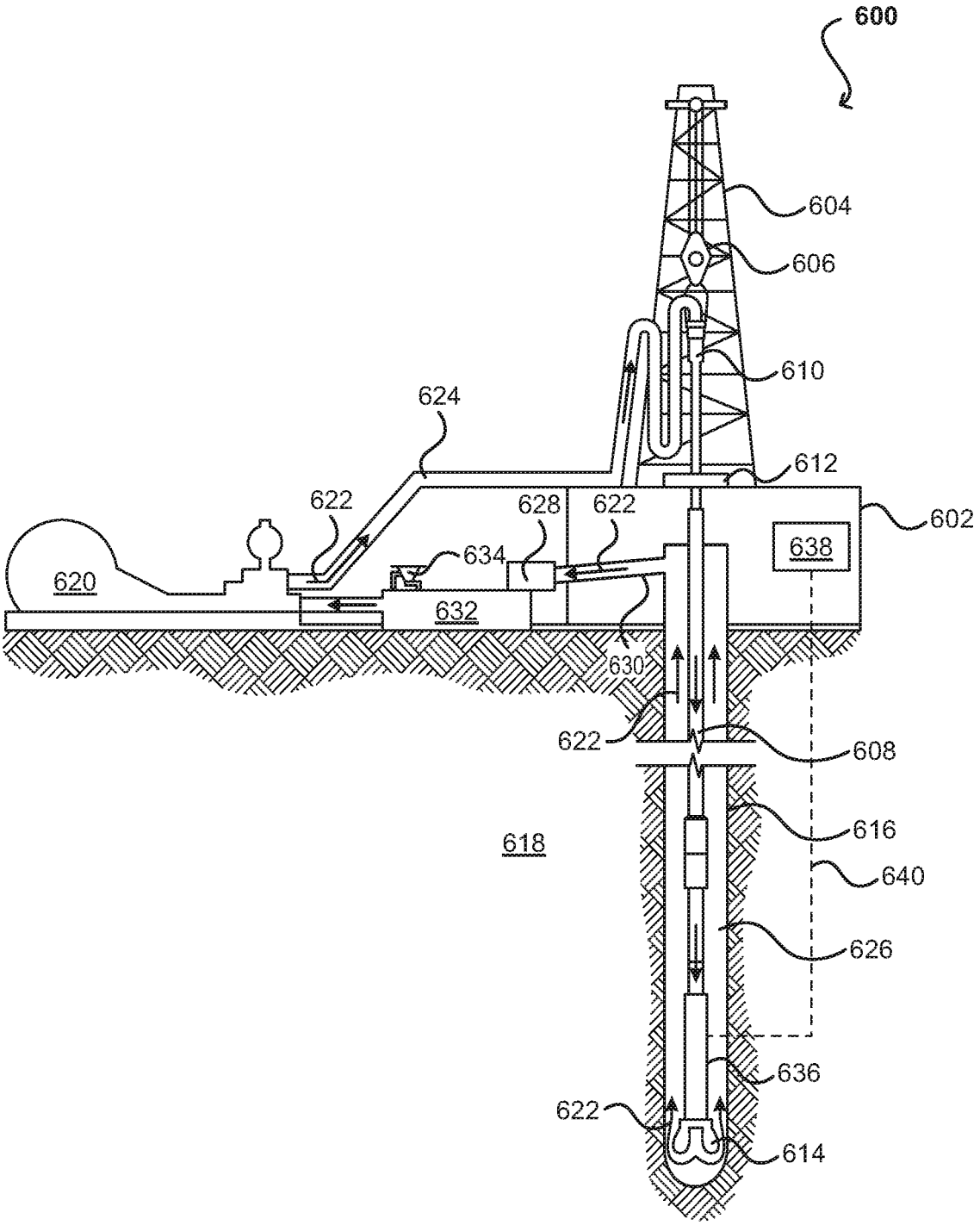
FIG. 6 illustrates an exemplary drilling assembly for implementing the processes described herein in accordance with some implementations.
Figure 8:
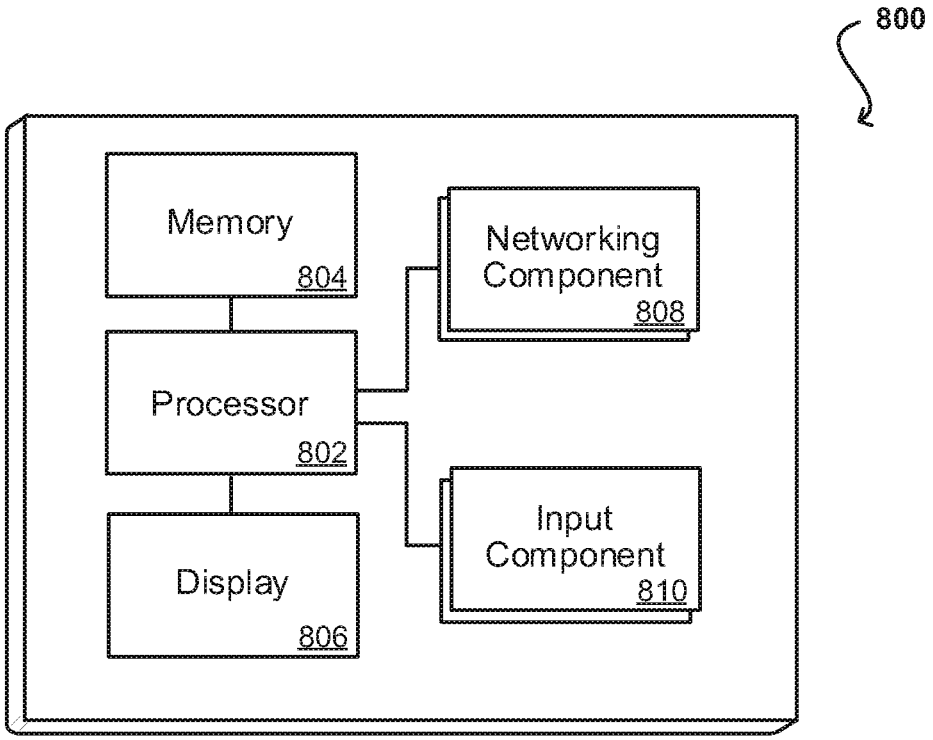
FIG. 8 illustrates a schematic diagram of a set of general components of an example computing device in accordance with some implementations.

In some implementations, the plots 500 may be generated and/or provided for display by one or more computing devices or systems, such as the processor 638 described in FIG. 6 and/or the computing device 800 described in FIG. 8.

As shown, the plots 500 include a plot 505 related to a ROP drilling parameter, a plot 510 for a flow differential parameter (e.g., flow gain as discussed above in equation (3)), a plot 515 for a WOB parameter, a plot 520 related to a SPP parameter, a plot 525 related to a RPM parameter, a plot 530 related to a torque parameter, a plot 535 related to an equivalent circulating density (ECD) parameter, a plot 540 related to a d-exponent parameter (e.g., as discussed above in equation (1)), and a plot 545 related to a gas parameter. By separating data of other drilling parameters into different plots, other kick indicators related to the other drilling parameters may be provided to determine respective trends, verify the kick indicated by the d-exponent parameter, and/or eliminate a false kick detection.

In the example of FIG. 5A, approximately ten minutes have elapsed between a time 501 corresponding to when a kick was detected based on the d-exponent parameter and a subsequent time 502 when the kick was observed in the field utilizing some of the aforementioned traditional practices. Consequently, it can be clearly shown that the described robust early kick techniques utilizing at least the d-exponent parameter significant improve the amount of time required to detect a kick using traditional kick detection practices. The illustrated d-exponent parameter in the plot 540 has deviated greater than a predetermined threshold value from an expected value of a normal trend (e.g., indicated as a straight line before time 501) at the time 501, which is detected by the robust early kick detection techniques described herein. Some drilling parameters, such as the weight on bit (WOB) shown in the plot 515 and drill string revolutions per minute (RPM) parameter shown in the plot 525, in an example, are adjustable in the field by the drilling operator/engineer, which can affect the rate of penetration (ROP) parameter shown in the plot 505.

After the time 501, the WOB parameter has decreased in the plot 515. The d-exponent parameter (e.g., determined using the equation (1) discussed above) in this example is utilized to detect the kick at the time 501, which follows the same general trend as the decrease of the WOB parameter indicating a potential occurrence of a kick. Further, the d-exponent parameter in this example also follows the same general trend as the decrease in the SPP parameter in the plot 520, which may be indicative of the occurrence of the kick during the drilling operation. The kick is detected in the field at the time 502 (~10 minutes after the time 501) based at least in part on the observation that the flow differential parameter is trending substantially upward or increasing and/or the ECD parameter has substantially decreased over the time period between the time 501 and 502.

As mentioned before, in some examples, the flow gain related to the flow differential parameter in the plot 510 may be utilized to confirm the robust early kick detection. In the example of FIG. 5A, after the time 501, the d-exponent parameter in the plot 540 has deviated from the normal trend (e.g., indicated as a straight dashed line after the time 501) as the parameter is not increasing as expected, and the flow differential parameter in the plot 510 has deviated from its expected trend (e.g., as indicated as a straight dashed line after the time 501), which more confidently verifies that the kick is detected at the time 501.

Figure 5B:
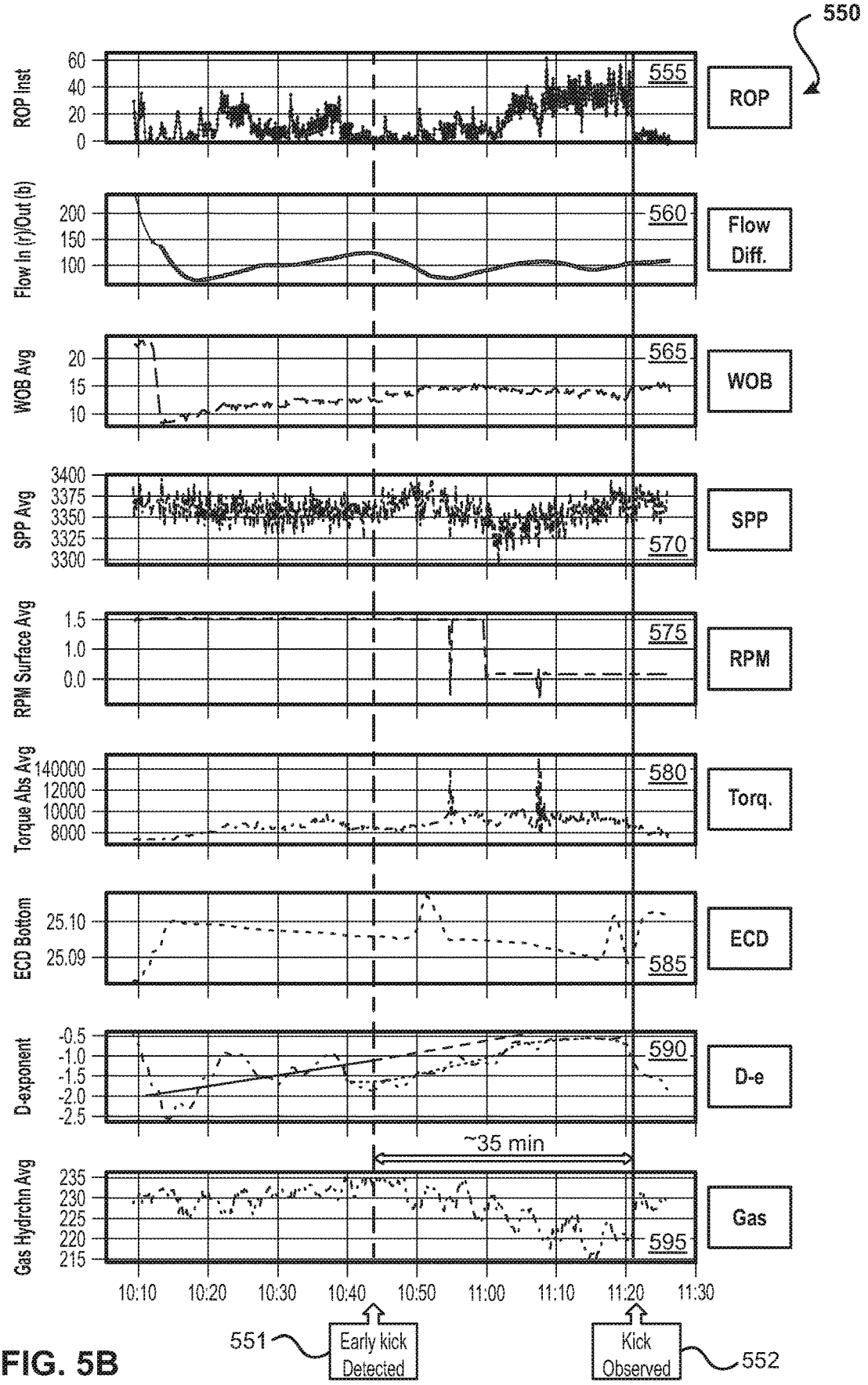
FIG. 5B illustrates example plots of real-time drilling data of a drilling operation including a d-exponent drilling parameter and other drilling parameters that may be utilized for robust early kick detection in accordance with some implementations.

FIG. 5B illustrates example plots 550 of real-time drilling data of a drilling operation including a d-exponent drilling parameter and other drilling parameters that may be utilized for robust early kick detection in accordance with some implementations. The example in FIG. 5B illustrates a difference between a time 551 when a kick is detected utilizing the d-exponent parameter and a subsequent time 552 when the kick is observed in the field. In some implementations, the plots 550 may be generated and/or provided for display by one or more computing devices or systems, such as the processor 638 described in FIG. 6 and/or the computing device 800 described in FIG. 8.

As shown, the plots 550 include a plot 555 related to a ROP drilling parameter, a plot 560 for a flow differential parameter (e.g., flow gain as discussed above in equation (3)), a plot 565 for a WOB parameter, a plot 570 related to a SPP parameter, a plot 575 related to a RPM parameter, a plot 580 related to a torque parameter, a plot 585 related to an equivalent circulating density (ECD) parameter, a plot 590 related to a d-exponent parameter (e.g., as discussed above in equation (1)), and a plot 595 related to a gas parameter.

In the example of FIG. 5B, approximately thirty-five (35) minutes have elapsed between a time 551 corresponding to when a kick was detected utilizing the d-exponent parameter and a subsequent time 552 when the kick was observed in the field utilizing one or more of the aforementioned traditional practices. The illustrated d-exponent parameter in the plot 590 has deviated greater than a predetermined threshold value from an expected value of a normal trend at the time 551, which is detected by the robust early kick detection techniques described herein. After the time 551, the WOB parameter in the plot 565 has remained in the same general trend, and the flow differential parameter related to flow gain in the plot 560 also has remained in the same general trend. The kick is detected in the field at the time 552 (~35 minutes after the time 551) based at least in part on the observation that the ROP parameter in the plot 555 has substantially increased at the time 552 and/or an amount of gas detected in the wellbore has suddenly increased as indicated in the plot 595 at the time 552.

In addition to the preceding examples illustrated in FIGS. 5A and 5B, the following table lists example data for different drilling operations at respective example wells when the robust early kick detection techniques utilizing a d-exponent parameter described herein (e.g., the process 200) are utilized.

TABLE 1

| Well Number | Kick Occurrence | Field Detection Time | EKD Time | Time Earlier (min) | Improvement Percentage |
|---|---|---|---|---|---|
| 1 | 1:06 AM | 1:16 AM | 1:09 AM | 7 | 70% |
| 2 | 6:38 PM | 6:49 PM | 6:40 PM | 9 | 80% |
| 3 | 11:01 AM | 11:20 AM | 11:08 AM | 12 | 63% |
| 4 | 12:13 AM | 12:19 AM | 12:15 AM | 4 | 50% |

As can be seen in the above table, robust early kick detection techniques applied in the respective drilling operations for well numbers 1-4, provide at least a fifty percent (50%) improvement between a time when a kick is detected utilizing the robust early kick detection techniques and a subsequent time when the kick is observed in the field utilizing one or more other drilling parameters and/or based on the field experience of the human operator. Thus, advantageously, the robust early kick detection techniques based on a d-exponent parameter significantly improve a time when a kick is detected in comparison with kick detection techniques based on other kick indicators.

Figure 7:
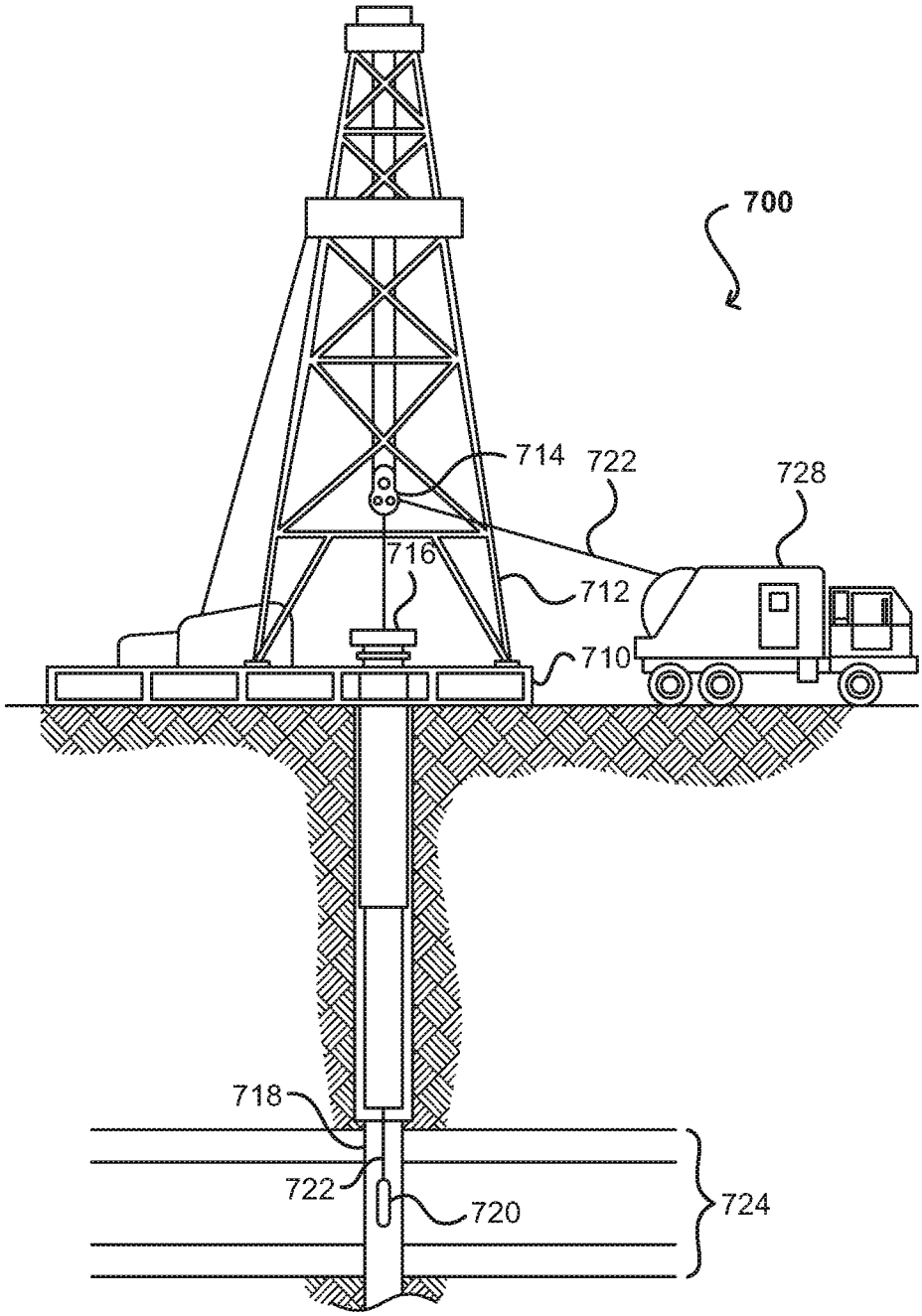
FIG. 7 illustrates a wireline system suitable for implementing the processes described herein in accordance with some implementations.

The following discussion in FIGS. 6 and 7 relate to examples of a drilling assembly and logging assembly for a given oil or gas well system that may be utilized to implement the robust early kick detection techniques described above.

Oil and gas hydrocarbons can naturally occur in some subterranean formations. In the oil and gas industry, a subterranean formation containing oil, gas, or water is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid. An oil or gas well system can be on land or offshore.

FIG. 6 illustrates an exemplary drilling assembly 600 for implementing the processes described herein. It should be noted that while FIG. 6 generally depicts a land-based drilling assembly, those skilled in the art will readily recognize that the principles described herein are equally applicable to subsea drilling operations that employ floating or sea-based platforms and rigs, without departing from the scope of the disclosure.

In one or more implementations, the process 200 and/or the process 300 described above begin before and/or while the drilling assembly 600 drills a wellbore 616 penetrating a subterranean formation 618. It is appreciated, however, that any processing performed in the process 200 and/or the process 300 by any appropriate component described herein may occur only uphole, only downhole, or at least some of both (i.e., distributed processing). As illustrated, the drilling assembly 600 may include a drilling platform 602 that supports a derrick 604 having a traveling block 606 for raising and lowering a drill string 608. The drill string 608 may include, but is not limited to, drill pipe and coiled tubing, as generally known to those skilled in the art. A kelly 610 supports the drill string 608 as it is lowered through a rotary table 612. A drill bit 614 is attached to the distal end of the drill string 608 and is driven either by a downhole motor and/or via rotation of the drill string 608 from the well surface. As the drill bit 614 rotates, it creates the wellbore 616 that penetrates various subterranean formations 618.

A pump 620 (e.g., a mud pump) circulates drilling mud 622 through a feed pipe 624 and to the kelly 610, which conveys the drilling mud 622 downhole through the interior of the drill string 608 and through one or more orifices in the drill bit 614. The drilling mud 622 is then circulated back to the surface via an annulus 626 defined between the drill string 608 and the walls of the wellbore 616. At the surface, the recirculated or spent drilling mud 622 exits the annulus 626 and may be conveyed to one or more fluid processing unit(s) 628 via an interconnecting flow line 630. After passing through the fluid processing unit(s) 628, a "cleaned" drilling mud 622 is deposited into a nearby retention pit 632 (i.e., a mud pit). While illustrated as being arranged at the outlet of the wellbore 616 via the annulus 626, those skilled in the art will readily appreciate that the fluid processing unit(s) 628 may be arranged at any other location in the drilling assembly 600 to facilitate its proper function, without departing from the scope of the scope of the disclosure.

Chemicals, fluids, additives, and the like may be added to the drilling mud 622 via a mixing hopper 634 communicably coupled to or otherwise in fluid communication with the retention pit 632. The mixing hopper 634 may include, but is not limited to, mixers and related mixing equipment known to those skilled in the art. In other implementations, however, the chemicals, fluids, additives, and the like may be added to the drilling mud 622 at any other location in the drilling assembly 600. In at least one implementation, for example, there may be more than one retention pit 632, such as multiple retention pits 632 in series. Moreover, the retention pit 632 may be representative of one or more fluid storage facilities and/or units where the chemicals, fluids, additives, and the like may be stored, reconditioned, and/or regulated until added to the drilling mud 622.

The processor 638 may be a portion of computer hardware used to implement the various illustrative blocks, modules, elements, components, methods, and algorithms described herein. The processor 638 may be configured to execute one or more sequences of instructions, programming stances, or code stored on a non-transitory, computer-readable medium. The processor 638 can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some implementations, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some implementations, such code can be read into the memory from another machine-readable medium. Execution of the sequences of instructions contained in the memory can cause a processor 638 to perform the process steps described herein. One or more processors 638 in a multi-processing arrangement can also be employed to execute instruction sequences in the memory. In addition, hard-wired circuitry can be used in place of or in combination with software instructions to implement various implementations described herein. Thus, the present implementations are not limited to any specific combination of hardware and/or software.

As used herein, a machine-readable medium will refer to any medium that directly or indirectly provides instructions to the processor 638 for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

The drilling assembly 600 may further include a bottom hole assembly (BHA) coupled to the drill string 608 near the drill bit 614. The BHA may comprise various downhole measurement tools such as, but not limited to, measurement-while-drilling (MWD) and logging-while-drilling (LWD) tools, which may be configured to take downhole and/or uphole measurements of the surrounding subterranean formations 618. Along the drill string 608, logging while drilling (LWD) or measuring while drilling (MWD) equipment 636 is included. In one or more implementations, the drilling assembly 600 involves drilling the wellbore 616 while the logging measurements are made with the LWD/MWD equipment 636. More generally, the methods described herein involve introducing a logging tool into the wellbore that is capable of determining wellbore parameters, including mechanical properties of the formation. The logging tool may be an LWD logging tool, a MWD logging tool, a wireline logging tool, slickline logging tool, and the like. Further, it is understood that any processing performed by the logging tool may occur only uphole, only downhole, or at least some of both (i.e., distributed processing).

According to the present disclosure, the LWD/MWD equipment 636 may include a stationary acoustic sensor and a moving acoustic sensor used to detect the flow of fluid flowing into and/or adjacent the wellbore 616. In an example, the stationary acoustic sensor may be arranged about the longitudinal axis of the LWD/MWD equipment 636, and, thus, of the wellbore 616 at a predetermined fixed location within the wellbore 616. The moving acoustic sensor may be arranged about the longitudinal axis of the LWD/MWD equipment 636, and, thus, of the wellbore 616, and is configured to move along the longitudinal axis of the wellbore 616. However, the arrangement of the stationary acoustic sensor and the moving acoustic sensor is not limited thereto and the acoustic sensors may be arranged in any configuration as required by the application and design.

The LWD/MWD equipment 636 may transmit the measured data to a processor 638 at the surface wired or wirelessly. Transmission of the data is generally illustrated at line 640 to demonstrate communicable coupling between the processor 638 and the LWD/MWD equipment 636 and does not necessarily indicate the path to which communication is achieved. The stationary acoustic sensor and the moving acoustic sensor may be communicably coupled to the line 640 used to transfer measurements and signals from the BHA to the processor 638 that processes the acoustic measurements and signals received by acoustic sensors (e.g., stationary acoustic sensor, moving acoustic sensor) and/or controls the operation of the BHA. In the subject technology, the LWD/MWD equipment 636 may be capable of logging analysis of the subterranean formation 618 proximal to the wellbore 616.

In some implementations, part of the processing may be performed by a telemetry module (not shown) in combination with the processor 638. For example, the telemetry module may pre-process the individual sensor signals (e.g., through signal conditioning, filtering, and/or noise cancellation) and transmit them to a surface data processing system (e.g., the processor 638) for further processing. It is appreciated that any processing performed by the telemetry module may occur only uphole, only downhole, or at least some of both (i.e., distributed processing).

In various implementations, the processed acoustic signals are evaluated in conjunction with measurements from other sensors (e.g., temperature and surface well pressure measurements) to evaluate flow conditions and overall well integrity. The telemetry module may encompass any known means of downhole communication including, but not limited to, a mud pulse telemetry system, an acoustic telemetry system, a wired communications system, a wireless communications system, or any combination thereof. In certain implementations, some or all of the measurements taken by the stationary acoustic sensor and the moving acoustic sensor may also be stored within a memory associated with the acoustic sensors or the telemetry module for later retrieval at the surface upon retracting the drill string 608.

FIG. 7 illustrates a logging assembly 700 having a wireline system suitable for implementing the methods described herein. As illustrated, a platform 710 may be equipped with a derrick 712 that supports a hoist 714. Drilling oil and gas wells, for example, are commonly carried out using a string of drill pipes connected together so as to form a drilling string that is lowered through a rotary table 716 into a wellbore 718. Here, it is assumed that the drilling string has been temporarily removed from the wellbore 718 to allow a logging tool 720 (and/or any other appropriate wireline tool) to be lowered by wireline 722, slickline, coiled tubing, pipe, downhole tractor, logging cable, and/or any other appropriate physical structure or conveyance extending downhole from the surface into the wellbore 718. Typically, the logging tool 720 is lowered to a region of interest and subsequently pulled upward at a substantially constant speed. During the upward trip, instruments included in the logging tool 720 may be used to perform measurements on the subterranean formation 724 adjacent the wellbore 718 as the logging tool 720 passes by. Further, it is understood that any processing performed by the logging tool 720 may occur only uphole, only downhole, or at least some of both (i.e., distributed processing).

The logging tool 720 may include one or more wireline instrument(s) that may be suspended into the wellbore 718 by the wireline 722. The wireline instrument(s) may include the stationary acoustic sensor and the moving acoustic sensor, which may be communicably coupled to the wireline 722. The wireline 722 may include conductors for transporting power to the wireline instrument and also facilitate communication between the surface and the wireline instrument. The logging tool 720 may include a mechanical component for causing movement of the moving acoustic sensor. In some implementations, the mechanical component may need to be calibrated to provide a more accurate mechanical motion when the moving acoustic sensor is being repositioned along the longitudinal axis of the wellbore 718.

The acoustic sensors (e.g., the stationary acoustic sensor, the moving acoustic sensor) may include electronic sensors, such as hydrophones, piezoelectric sensors, piezoresistive sensors, electromagnetic sensors, accelerometers, or the like. In other implementations, the acoustic sensors may comprise fiber optic sensors, such as point sensors (e.g., fiber Bragg gratings, etc.) distributed at desired or predetermined locations along the length of an optical fiber. In yet other implementations, the acoustic sensors may comprise distributed acoustic sensors, which may also use optical fibers and permit a distributed measurement of local acoustics at any given point along the fiber. In still other implementations, the acoustic sensors may include optical accelerometers or optical hydrophones that have fiber optic cablings.

Additionally or alternatively, in an example (not explicitly illustrated), the acoustic sensors may be attached to or embedded within the one or more strings of casing lining the wellbore 718 and/or the wall of the wellbore 718 at an axially spaced pre-determined distance.

A logging facility 728, shown in FIG. 7 as a truck, may collect measurements from the acoustic sensors (e.g., the stationary acoustic sensor, the moving acoustic sensor), and may include the processor 638 for controlling, processing, storing, and/or visualizing the measurements gathered by the acoustic sensors. The processor 638 may be communicably coupled to the wireline instrument(s) by way of the wireline 722. Alternatively, the measurements gathered by the logging tool 720 may be transmitted (wired or wirelessly) or physically delivered to computing facilities off-site where the methods and processes described herein may be implemented.

FIG. 8 illustrates a schematic diagram of a set of general components of an example computing device 800. In this example, the computing device 800 includes a processor 802 for executing instructions that can be stored in a memory device or element 804. The computing device 800 can include many types of memory, data storage, or non-transitory computer-readable storage media, such as a first data storage for program instructions for execution by the processor 802, a separate storage for images or data, a removable memory for sharing information with other devices, etc.

The computing device 800 typically may include some type of display element 806, such as a touch screen or liquid crystal display (LCD). As discussed, the computing device 800 in many embodiments will include at least one input element 810 able to receive conventional input from a user. This conventional input can include, for example, a push button, touch pad, touch screen, wheel, joystick, keyboard, mouse, keypad, or any other such device or element whereby a user can input a command to the device. In some embodiments, however, such the computing device 800 might not include any buttons at all, and might be controlled only through a combination of visual and audio commands, such that a user can control the computing device 800 without having to be in contact with the computing device 800. In some embodiments, the computing device 800 of FIG. 8 can include one or more network interface elements 808 for communicating over various networks, such as a Wi-Fi, Bluetooth, RF, wired, or wireless communication systems. The computing device 800 in many embodiments can communicate with a network, such as the Internet, and may be able to communicate with other such computing devices.

Figure 9:
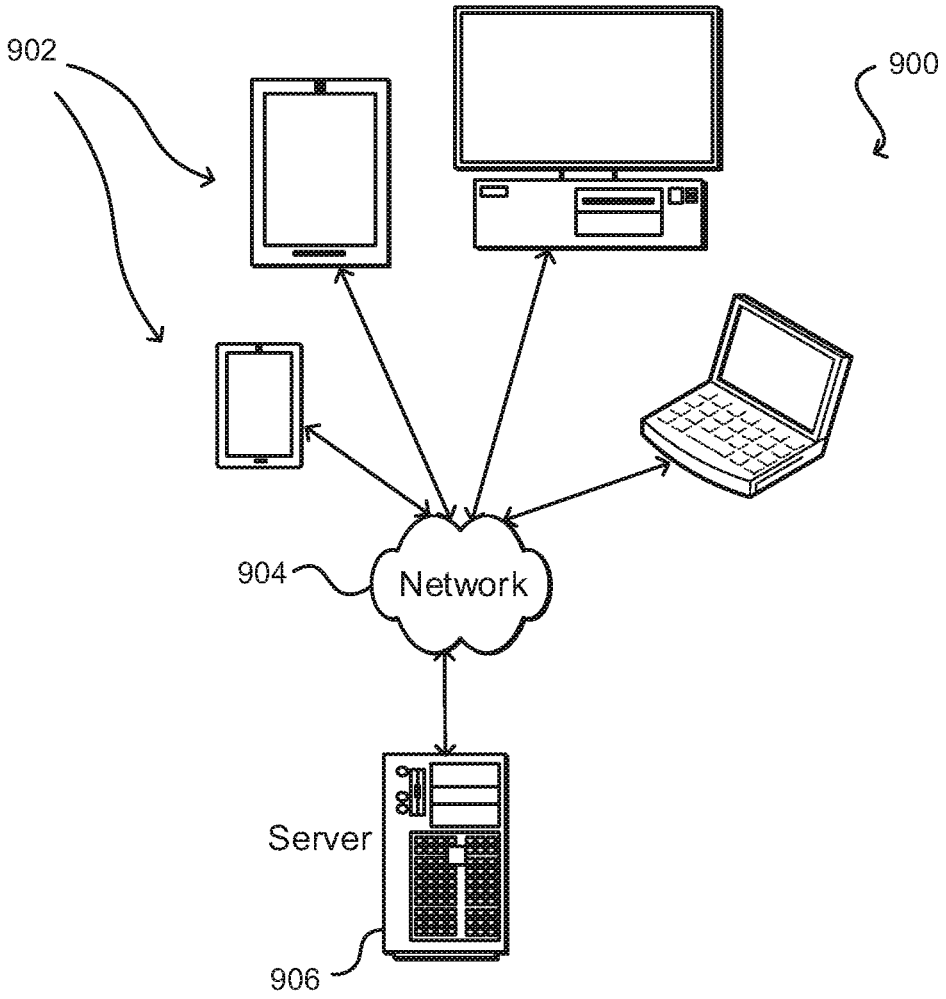
FIG. 9 illustrates a schematic diagram of an example of an environment for implementing aspects in accordance with some implementations.

As discussed herein, different approaches can be implemented in various environments in accordance with the described embodiments. For example, FIG. 9 illustrates a schematic diagram of an example of an environment 900 for implementing aspects in accordance with various embodiments. As will be appreciated, although a client-server based environment is used for purposes of explanation, different environments may be used, as appropriate, to implement various embodiments. The system includes an electronic client device 902, which can include any appropriate device operable to send and receive requests, messages or information over an appropriate network 904 and convey information back to a user of the device. Examples of such client devices include personal computers, cell phones, handheld messaging devices, laptop computers, set-top boxes, personal data assistants, electronic book readers and the like.

The network 904 can include any appropriate network, including an intranet, the Internet, a cellular network, a local area network or any other such network or combination thereof. The network 904 could be a "push" network, a "pull" network, or a combination thereof. In a "push" network, one or more of the servers push out data to the client device. In a "pull" network, one or more of the servers send data to the client device upon request for the data by the client device. Components used for such a system can depend at least in part upon the type of network and/or environment selected. Protocols and components for communicating via such a network are well known and will not be discussed herein in detail. Computing over the network 904 can be enabled via wired or wireless connections and combinations thereof. In this example, the network includes the Internet, as the environment includes a server 906 for receiving requests and serving content in response thereto, although for other networks, an alternative device serving a similar purpose could be used, as would be apparent to one of ordinary skill in the art.

The client device 902 may represent the logging tool 720 of FIG. 7 and the server 906 may represent the processor 638 of FIG. 6 in some implementations, or the client device 902 may represent the processor 638 and the server 906 may represent the off-site computing facilities in other implementations.

The server 906 typically will include an operating system that provides executable program instructions for the general administration and operation of that server and typically will include computer-readable medium storing instructions that, when executed by a processor of the server, allow the server to perform its intended functions. Suitable implementations for the operating system and general functionality of the servers are known or commercially available and are readily implemented by persons having ordinary skill in the art, particularly in light of the disclosure herein.

The environment in one embodiment is a distributed computing environment utilizing several computer systems and components that are interconnected via computing links, using one or more computer networks or direct connections. However, it will be appreciated by those of ordinary skill in the art that such a system could operate equally well in a system having fewer or a greater number of components than are illustrated in FIG. 9. Thus, the depiction of the environment 900 in FIG. 9 should be taken as being illustrative in nature and not limiting to the scope of the disclosure.

Storage media and other non-transitory computer readable media for containing code, or portions of code, can include any appropriate storage media used in the art, such as but not limited to volatile and non-volatile, removable and non-removable media implemented in any method or technology for storage of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various implementations.

Further Considerations

Various examples of aspects of the disclosure are described below as clauses for convenience. The methods of any preceding paragraph, either alone or in combination may further include the following clauses. These are provided as examples, and do not limit the subject technology.

Clause 1. A method comprising: receiving real-time drilling data comprising a plurality of different drilling parameters measured during a drilling operation; calculating a kick detection parameter based at least in part on the plurality of different drilling parameters; detecting an occurrence of a kick during the drilling operation when the kick detection parameter deviates from a trend formed by previously calculated kick detection parameters; and activating an alarm during the drilling operation in response to detecting the occurrence of the kick to facilitate preventing a blowout.

Clause 2. The method of Clause 1, wherein the plurality of different drilling parameters comprise at least one of a rate of penetration (ROP) parameter, a weight on bit (WOB) parameter, a drill string revolutions per minute (RPM) parameter, or a diameter of a drill bit utilized in the drilling operation, and the kick detection parameter comprises a d-exponent parameter.

Clause 3. The method of Clause 1, further comprising: calculating an expected kick detection parameter based at least in part on the trend formed by the previously calculated kick detection parameters; and determining that the kick detection parameter deviates from the trend when the kick detection parameter deviates from the expected kick detection parameter by a predetermined threshold amount.

Clause 4. The method of Clause 1, further comprising: determining values of a flow gain parameter based on the received real-time drilling data, the flow gain parameter based at least in part on a flow in rate, a flow out rate, a stand pipe pressure (SPP) parameter, and a compressibility of drilling mud; determining a gradient of the values of the flow gain parameter; and determining whether a change in the gradient is greater than a threshold value indicating a sudden increase of the flow gain parameter.

Clause 5. The method of Clause 4, further comprising: verifying the occurrence of the kick during the drilling operation based on the kick detection parameter deviating from the trend and the change in the gradient being greater than the threshold value.

Clause 6. The method of Clause 1, further comprising: deactivating a drill string to cease the drilling operation in response to activating the alarm.

Clause 7. The method of Clause 6, wherein deactivating the drill string to cease the drilling operation further comprises: initiating a deactivation process for the drill string, the deactivation process being performed after a predetermined amount of time has elapsed without receiving user input subsequent to activating the alarm.

Clause 8. The method of Clause 1, wherein receiving real-time drilling data is in response to determining that the drilling operation is occurring based at least in part on determining that at least one pump of a drilling assembly is active and a depth of a drill bit is increasing.

Clause 9. The method of Clause 1, wherein the received real-time drilling data is provided by a logging tool or other sensors installed on a drilling system.

Clause 10. The method of Clause 1, further comprising: in response to determining that the kick detection parameter does not deviate from the trend formed by previously calculated kick detection parameters, receiving second real-time drilling data, the second real-time drilling data being measured over a subsequent period of time for the drilling operation; and determining particular values of the kick detection parameter over the subsequent period of time based on the received second real-time drilling data.

Clause 11. A system comprising: a processor; and a memory device including instructions that, when executed by the processor, cause the processor to: receive real-time drilling data comprising a plurality of different drilling parameters measured during a drilling operation; calculate a kick detection parameter based at least in part on the plurality of different drilling parameters; detect an occurrence of a kick during the drilling operation when the kick detection parameter deviates from a trend formed by previously calculated kick detection parameters; and activate an alarm during the drilling operation in response to detection of the occurrence of the kick.

Clause 12. The system of Clause 11, wherein the plurality of different drilling parameters comprise at least one of a rate of penetration (ROP) parameter, a weight on bit (WOB) parameter, a drill string revolutions per minute (RPM) parameter, or a diameter of a drill bit utilized in the drilling operation, and the kick detection parameter comprises a d-exponent parameter.

Clause 13. The system of Clause 11, wherein the instructions further cause the processor to: calculate an expected kick detection parameter based at least in part on the trend formed by the previously calculated kick detection parameters; and determine that the kick detection parameter deviates from the trend when the kick detection parameter deviates from the expected kick detection parameter by a predetermined threshold amount.

Clause 14. The system of Clause 11, wherein the instructions further cause the processor to: determine values of a flow gain parameter based on the received real-time drilling data, the flow gain parameter based at least in part on a flow in rate, a flow out rate, a stand pipe pressure (SPP) parameter, and a compressibility of drilling mud; determine a gradient of the values of the flow gain parameter; and determine whether a change in the gradient is greater than a threshold value indicating a sudden increase of the flow gain parameter.

Clause 15. The system of Clause 14, wherein the instructions further cause the processor to: verify the occurrence of the kick during the drilling operation based on the kick detection parameter deviating from the trend and the change in the gradient is greater than the threshold value.

Clause 16. The system of Clause 11, wherein the instructions further cause the processor to: deactivating a drill string to cease the drilling operation in response to activating the alarm.

Clause 17. The system of Clause 16, wherein to deactivate the drill string to cease the drilling operation further causes the processor to: initiate a deactivation process for the drill string, the deactivation process being performed after a predetermined amount of time has elapsed without receiving user input.

Clause 18. The system of Clause 11, wherein to receive real-time drilling data is in response to determining that the drilling operation is occurring based at least in part on determining that at least one pump of a drilling assembly is active and a depth of a drill bit is increasing.

Clause 19. The system of Clause 11, wherein the received real-time drilling data is provided by a logging tool or other sensors installed on a drilling system.

Clause 20. A non-transitory computer-readable medium including instructions stored therein that, when executed by at least one computing device, cause the at least one computing device to perform operations including: receiving real-time drilling data, the real-time drilling data being measured over a period of time during a drilling operation performed by a drilling rig and one or more measurement tools; determining values of a kick detection parameter over the period of time based on the received real-time drilling data, wherein the kick detection parameter is determined from a plurality of different drilling parameter values of the real-time drilling data; determining a normal trend based on the values of the kick detection parameter over the period of time; determining whether subsequent values of the kick detection parameter deviate from the normal trend, the subsequent values of the kick detection parameter being measured during a subsequent period of time after the period of time; detecting an occurrence a kick during the drilling operation when the values of the kick detection parameter deviate from the normal trend; and activating an alarm during the drilling operation in response to detected occurrence of the kick, the alarm indicating the detected occurrence of the kick during the drilling operation performed by the drill string.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A method comprising:

receiving real-time drilling data comprising a plurality of different drilling parameters measured during a drilling operation;

calculating a kick detection parameter based at least in part on the plurality of different drilling parameters;

detecting a deviation of the kick detection parameter from a trend formed by previously calculated kick detection parameters;

activating an alarm during the drilling operation in response to detecting the the deviation of the kick detection parameter to facilitate preventing a blowout, the alarm indicating a potential occurrence of a kick during the drilling operation;

determining values of a flow gain parameter based on the received real-time drilling data, the flow gain parameter based at least in part on a flow in rate, a flow out rate, a stand pipe pressure (SPP) parameter, and a compressibility of drilling mud;

determining a gradient of the flow gain parameter from the values of the flow gain parameter determined; and determining whether a change in the gradient of the flow gain parameter is greater than a threshold value of the gradient indicating a sudden increase of the flow gain parameter.

2. The method of claim 1, wherein the plurality of different drilling parameters comprise at least one of a rate of penetration (ROP) parameter, a weight on bit (WOB) parameter, a drill string revolutions per minute (RPM)

parameter, or a diameter of a drill bit utilized in the drilling operation, and the kick detection parameter comprises a d-exponent parameter.

3. The method of claim 1, further comprising:

calculating an expected kick detection parameter based at least in part on the trend formed by the previously calculated kick detection parameters; and determining that the kick detection parameter deviates from the trend when the kick detection parameter deviates from the expected kick detection parameter by a predetermined threshold amount.

4. The method of claim 1, further comprising:

verifying the occurrence of the kick during the drilling operation based on the kick detection parameter deviating from the trend and the change in the gradient being greater than the threshold value.

5. The method of claim 1, further comprising:

deactivating a drill string to cease the drilling operation in response to activating the alarm.

6. The method of claim 5, wherein deactivating the drill string to cease the drilling operation further comprises:

initiating a deactivation process for the drill string, the deactivation process being performed after a predetermined amount of time has elapsed without receiving user input subsequent to activating the alarm.

7. The method of claim 1, wherein receiving real-time drilling data is in response to determining that the drilling operation is occurring based at least in part on determining that at least one pump of a drilling assembly is active and a depth of a drill bit is increasing.

8. The method of claim 1, wherein the received real-time drilling data is provided by a logging tool or other sensors installed on a drilling system.

9. The method of claim 1, further comprising:

in response to determining that the kick detection parameter does not deviate from the trend formed by previously calculated kick detection parameters, receiving second real-time drilling data, the second real-time drilling data being measured over a subsequent period of time for the drilling operation; and determining particular values of the kick detection parameter over the subsequent period of time based on the received second real-time drilling data.

10. A system comprising:

a processor; and a memory device including instructions that, when executed by the processor, cause the processor to:

receive real-time drilling data comprising a plurality of different drilling parameters measured during a drilling operation;

calculate a kick detection parameter based at least in part on the plurality of different drilling parameters;

detect a deviation of the kick detection parameter from a trend formed by previously calculated kick detection parameters;

activate an alarm during the drilling operation in response to detection of the deviation of the kick detection parameter, the alarm indicating a potential occurrence of a kick during the drilling operation;

determine values of a flow gain parameter based on the received real-time drilling data, the flow gain parameter based at least in part on a flow in rate, a flow out rate, a stand pipe pressure (SPP) parameter, and a compressibility of drilling mud;

determine a gradient of the flow gain parameter from the values of the flow gain parameter determined; and determine whether a change in the gradient of the flow gain parameter is greater than a threshold value of the gradient indicating a sudden increase of the flow gain parameter.

11. The system of claim 10, wherein the plurality of different drilling parameters comprise at least one of a rate of penetration (ROP) parameter, a weight on bit (WOB) parameter, a drill string revolutions per minute (RPM) parameter, or a diameter of a drill bit utilized in the drilling operation, and the kick detection parameter comprises a d-exponent parameter.

12. The system of claim 10, wherein the instructions further cause the processor to:

calculate an expected kick detection parameter based at least in part on the trend formed by the previously calculated kick detection parameters; and determine that the kick detection parameter deviates from the trend when the kick detection parameter deviates from the expected kick detection parameter by a predetermined threshold amount.

13. The system of claim 10, wherein the instructions further cause the processor to:

verify the occurrence of the kick during the drilling operation based on the kick detection parameter deviating from the trend and the change in the gradient is greater than the threshold value.

14. The system of claim 10, wherein the instructions further cause the processor to:

deactivating a drill string to cease the drilling operation in response to activating the alarm.

15. The system of claim 14, wherein to deactivate the drill string to cease the drilling operation further causes the processor to:

initiate a deactivation process for the drill string, the deactivation process being performed after a predetermined amount of time has elapsed without receiving user input.

16. The system of claim 10, wherein to receive real-time drilling data is in response to determining that the drilling operation is occurring based at least in part on determining that at least one pump of a drilling assembly is active and a depth of a drill bit is increasing.

17. The system of claim 10, wherein the received real-time drilling data is provided by a logging tool or other sensors installed on a drilling system.

18. A non-transitory computer-readable medium including instructions stored therein that, when executed by at least one computing device, cause the at least one computing device to perform operations including:

receiving real-time drilling data, the real-time drilling data being measured over a period of time during a drilling operation performed by a drilling rig and one or more measurement tools;

determining values of a kick detection parameter over the period of time based on the received real-time drilling data, wherein the kick detection parameter is determined from a plurality of different drilling parameter values of the real-time drilling data;

determining a normal trend based on the values of the kick detection parameter over the period of time;

determining whether subsequent values of the kick detection parameter deviate from the normal trend, the subsequent values of the kick detection parameter being measured during a subsequent period of time after the period of time;

detecting a deviation of the values of the kick detection parameter from the normal trend;

activating an alarm during the drilling operation in response to detection of the deviation of the values of the kick detection parameter, the alarm indicating a potential occurrence of a kick during the drilling operation performed by the drill string;

determining values of a flow gain parameter based on the received real-time drilling data, the flow gain parameter based at least in part on a flow in rate, a flow out rate, a stand pipe pressure (SPP) parameter, and a compressibility of drilling mud, determining a gradient of the flow gain parameter from the values of the flow gain parameter determined; and determining whether a change in the gradient of the flow gain parameter is greater than a threshold value of the gradient indicating a sudden increase of the flow gain parameter.

19. The non-transitory computer-readable medium of claim 18, wherein the instructions further cause the at least one computing device to:

verify the occurrence of the kick during the drilling operation based on the kick detection parameter deviating from the trend and the change in the gradient being greater than the threshold value.

20. The non-transitory computer-readable medium of claim 18, wherein the kick detection parameter comprises a d-exponent parameter.

* * * * *